US007196461B2

(12) United States Patent
Yoon et al.

(10) Patent No.: US 7,196,461 B2
(45) Date of Patent: Mar. 27, 2007

(54) STRUCTURE OF ELECTRON GUN FOR CATHODE RAY TUBE

(75) Inventors: Hi Won Yoon, Daegu-si (KR); Moon Sik Kim, Gyeongsangbuk-do (KR); Youn Jin Kim, Gumi-si (KR); Jun Ho Bae, Daegu-si (KR); Hyun Choi, Gumi-si (KR); Dae Sik Hwang, Gumi-si (KR)

(73) Assignee: LG.Philips Displays Korea Co., Ltd., Gumi-si (KR)

( * ) Notice: Subject to any disclaimer, the term of this patent is extended or adjusted under 35 U.S.C. 154(b) by 245 days.

(21) Appl. No.: 10/900,308

(22) Filed: Jul. 28, 2004

(65) Prior Publication Data

US 2005/0088074 A1 Apr. 28, 2005

(30) Foreign Application Priority Data

Oct. 23, 2003 (KR) ..... 10-2003-0074091

(51) Int. Cl.
*H01J 29/50* (2006.01)
*H01J 29/51* (2006.01)
*H01J 29/46* (2006.01)

(52) U.S. Cl. ..... 313/414; 313/409; 313/446

(58) Field of Classification Search ..... 313/414
See application file for complete search history.

(56) References Cited

U.S. PATENT DOCUMENTS 5,281,896 A * 1/1994 Bae et al. ..... 313/414
5,600,201 A * 2/1997 Yun et al. ..... 313/414
5,734,235 A * 3/1998 Noguchi ..... 313/414
5,760,550 A * 6/1998 Sukeno et al. ..... 313/414
5,831,399 A * 11/1998 Ohta et al. ..... 313/414
5,841,224 A * 11/1998 Kim et al. ..... 313/414
5,939,820 A 8/1999 Jo
5,990,637 A * 11/1999 Cho ..... 313/414
5,994,826 A * 11/1999 Ueno et al. ..... 313/414
6,621,202 B2 * 9/2003 Kimiya et al. ..... 313/414
6,696,675 B2 2/2004 Morrison
6,919,675 B2 * 7/2005 Uchida et al. ..... 313/414
2004/0041511 A1 3/2004 Go et al.

FOREIGN PATENT DOCUMENTS

CN 1147143 A 4/1997
CN 1492467 A 8/2002

* cited by examiner

*Primary Examiner*—Nimeshkumar D. Patel
*Assistant Examiner*—Natalie K. Walford
(74) *Attorney, Agent, or Firm*—Birch, Stewart, Kolasch & Birch, LLP

(57) ABSTRACT

The present invention relates in general to a cathode ray tube, more particularly, to a structure of an electron gun for enhancing resolution of a cathode ray tube. The structure of an electron gun for a cathode ray tube of the invention is effective for enhancing the resolution of the screen without an application of a dynamic voltage.

27 Claims, 29 Drawing Sheets

[Horizontal direction]

[Vertical direction]

473

STRUCTURE OF ELECTRON GUN FOR CATHODE RAY TUBE

This Non-provisional application claims priority under 35 U.S.C. § 119(a) on Patent Application No(s). 10-2003-074091 filed in Korea, Republic of on Oct. 23, 2003, the entire contents of which are hereby incorporated by reference.

BACKGROUND OF THE INVENTION

1. Field of the Invention

The present invention relates to a cathode ray tube, more particularly, to a structure of an electron gun for enhancing resolution of a cathode ray tube.

2. Discussion of the Related Art

FIG. 1 is a diagram illustrating the structure of a color cathode ray tube of the related art.

Referring to FIG. 1, the color cathode ray tube of the related art includes a front side glass panel 1, and a rear side glass funnel 2 connected to the panel 1. The panel 1 and the funnel 2 are connected to each other in a manner that their inside is in a vacuum state, thereby forming a vacuum tube. Inside surface of the panel 1 is a fluorescent screen 11, and an electron gun 8 is housed in the funnel 2 on the opposite side of the fluorescent screen 11.

A shadow mask 3 with an electron beam color selecting function is situated at a predetermined distance from the fluorescent screen 11, and the shadow mask 3 is coupled with a mask frame 4.

Also, the mask frame 4, which is connected to a mask spring 5, is connected to a stud pin 6 to be supported to the panel 1.

The mask frame 4 is jointed with an inner shield 7 made of magnetic material to reduce the movement of an electron beam 5 caused by an external magnetic field. Accordingly, the effect of a geomagnetic field at the rear side of the cathode ray tube is reduced.

On the other hand, a convergence purity magnet (CPM) 10 for adjusting R, G and B electron beams emitted from the electron gun 8 to be converged on one spot, and a deflection yoke 9 for deflecting the electron beams are mounted on a neck portion of the funnel.

Also, a reinforcing band 12 is used to reinforce the front surface glass under the influence of a high interval vacuum state of the tube.

To briefly explain how the color cathode ray tube with the above construction operates, the electron beams emitted from the electron gun 8 are deflected in the horizontal and vertical directions by the deflection yoke 9, and the horizontally/vertically deflected electron beams pass through a beam passing hole on the shadow mask 3 and eventually strike the fluorescent screen 11, thereby displaying a desired image.

FIG. 2 depicts the structure of an electron gun of the related art.

As illustrated in FIG. 2, the electron gun 8 of the related art can largely be divided into three parts: a triode unit, a main lens, and a pre-focus lens between the triode unit and the main lens.

The triode unit includes a cathode 21 having a built-in heater 20, a control electrode 22 for controlling electron beams emitted from the cathode 21, and an accelerating electrode 23 for accelerating the electron beams, in which the cathode 21, the control electrode 22, and the accelerating electrode 23 are arranged in-line.

The main lens includes a main focus electrode 26 and an anode 27 for focusing electron beams generated from the triode unit and accelerating the electron beams in the end. More specifically, the main focus electrode 26 includes a cap electrode 261 having a race track shaped rim portion, and an electrostatic field control electrode 262. The anode 27 includes a cup electrode 271 having a race track shaped rip portion and an electrostatic field control electrode 272. Here, the electrostatic field control electrodes 262 and 272 are to equalize convergence force of three electron beams, and recessed to a certain direction from the cap electrode 261 or the cup electrode 271. FIG. 3 illustrates the anode 27 seen in D direction of *Fig*. 1, and FIG. 4 illustrates the main focus electrode 26 seen in C direction of FIG. 1.

The pre-focus lens includes a first pre-focus electrode 24 and a plate-shaped second pre-focus electrode 25.

The control electrode 22 is earthed. A voltage of 500–1000V is applied to the accelerating electrode 23 while a high voltage of 25–35 KV is applied to the anode 27. An intermediate voltage, e.g., 20–30% of the applied voltage to the anode 27, is applied to the main focus electrode 26.

When a designated voltage is applied to each of the electrodes of the electron gun 8, the electron beams generated at the triode unit are focused and accelerated, and later strike the fluorescent screen 11.

In general, for a cathode ray tube using an in-line electron gun, Red, Green and Blue electron beams are aligned horizontally. Thus a self-convergence type deflection yoke 9 that converges three electron beams to one spot is usually used.

As shown in FIG. 5, the self-convergence type deflection yoke 9 makes a horizontal deflection magnetic field (HB) in a pin-cushion shape, and a vertical deflection magnetic field (VB) in a barrel shape, resulting in the prevention of a mis-convergence problem on the fluorescent screen 11.

The magnetic fields can be categorized into diode and tetrode magnetic fields. The diode magnetic field deflects electron beams in horizontal and vertical directions. On the other hand, the tetrode magnetic field converges electron beams in the vertical direction and diverges in the horizontal direction, thereby causing astigmatism. In result, the shape of the electron beam spot is distorted and focusing characteristics thereof are deteriorated.

To elaborate the above phenomenon with reference to FIG. 11, although the magnetic field is almost perfectly uniform, an astigmatism phenomenon occurs to the electron beams in a peripheral portion of the fluorescent screen 11 (i.e. a peripheral portion of the screen) by a minute pin-cushion or barrel magnetic field component. Therefore, the shape of the electron beam spot is distorted and focusing characteristics thereof are deteriorated.

More specifically, a deflection magnetic field is not applied to the central portion of the fluorescent screen 11, so the electron beam spot has a circular shape. In the peripheral portion of the fluorescent screen 11, however, the electron beams are diverged in the horizontal (H) direction and overly converged in the vertical (V) direction, causing a low-density haze phenomenon to a high-density horizontally elongated core and the upper and lower parts of the core. Especially, deterioration in the resolution is worse at the peripheral portion of the screen. This problem gets worse for large cathode ray tubes and great deflection angles.

Basically the haze phenomenon at the peripheral portion of the screen occurs because the influence of deflection aberration is greater at the center of the deflection yoke 9. For example, the electron beams in the horizontal direction are almost circular because the divergence force of the deflection magnetic field and the convergence force by a distance difference are cancelled out or counterbalanced with each other. On the contrary, in the vertical direction the convergence force by the deflection aberration and the convergence force by the distance difference are superposed, resulting in the occurrence of the haze phenomenon.

Therefore, to get rid of the haze phenomenon, the triode unit should be adjusted properly.

FIG. 6 illustrates a control electrode in an electron gun of the related art.

Referring to FIG. 6, an electron beam passing hole 221 of the control electrode 22 has a circular shape, and the diameter of the passing hole is about 0.5 mm–0.7 mm. The thickness of the electrode around the electron beam passing hole 221 ranges from 0.08 mm to 0.1 mm.

Now referring to an accelerating electrode 23 in FIG. 7, there is a slot 232 formed on the circumference of each electron beam passing hole 231. More specifically, the slot 232 is formed on the opposite side of a first pre-focus electrode 24 (shown in FIG. 8), and the shape of the electron beam passing hole 231 is a circle or square. The thickness of the accelerating electrode 23 is approximately 0.37 mm, and the depth of the slot 232 is approximately 0.15 mm, which is about 40% of the entire thickness of the accelerating electrode 23. Also, the slot 232 is horizontally elongated, that is, the horizontal size of the slot 232 is greater than the vertical size thereof. This horizontally elongated slot 232 serves to reduce the haze phenomenon at the peripheral portion of the screen.

FIG. 8 illustrates a first pre-focus electrode 24. The diameter of an electron beam passing hole 241 of the first pre-focus electrode 24 ranges from 0.9 mm to 1.5 mm.

FIG. 9 illustrates a second pre-focus electrode 25. The second pre-focus electrode 25 is in a plate shape, and the diameter of an electron beam passing hole 251 thereof ranges from 3.0 mm to 4.0 mm. In some cases, the second pre-focus electrode 25 takes a cap or cup shape. Because an applied voltage to the second pre-focus electrode 25 is low, a pre-focus lens is formed around the second pre-focus electrode 25.

As shown in FIG. 10, the size of an electron beam incident on a main lens, Db, is determined by divergence angle of an electron beam generated at the triode unit and by convergence force of the pre-focus lens. In FIG. 10, Db (H) indicates a horizontal size of the electron beam, and Db (V) indicates a vertical size of the electron beam.

In general, among other design characteristics of an electron gun 8, lens magnification, repulsive space charge (electric force), and spherical aberration of the main lens are major factors that influence spot size of an electron beam formed on the fluorescent screen 11.

The lens magnification actually does not have much effect on the spot size (Dx) and its utility as a design element of the electron gun is very low because there are several fixed conditions like a voltage, a focal length, and a length of the electron gun.

On the other hand, the influence of the repulsive space charge force on the spot size (Dst) indicates a phenomenon that the spot size (Dst) is enlarged due to the repulsion and the collision between electrons in the electron beam. To obviate such phenomenon, a special designing is needed to increase an angle to which the electron beams travel (hereinafter, it is referred to as 'emission angle').

The influence of the spherical aberration of the main lens on the spot size (Dic) indicates a phenomenon that the spot size (Dic) is enlarged due to the difference between focal lengths of an electron that passed through a short axis of the lens and an electron that passed through a long axis of the lens. Unlike the repulsive space charge force, if the beam emission angle on the main lens is small, the spot size on the fluorescent screen 15 can be reduced.

To summarize the above, the spot size (Dt) on the fluorescent screen 15 can be expressed as follows:

$$Dt=\sqrt{(Dx+Dst)^2+Dic^2}$$

When it comes to the electron gun of the related art, the size (Db) of an electron beam incident on the main lens is approximately 2.5 mm–3.0 mm. When Db is greater than the range, the spot size is increased due to spherical aberration, and when Db is less than the range, the spot size is again increased due to repulsive space charge (electric) force.

As shown in FIG. 11, in the electron gun of the related art, the haze phenomenon is more prevalent in the vertical direction as it gets closer to the peripheral portion of the screen. To suppress this phenomenon, a slot is formed on an accelerating electrode 23 as illustrated in FIG. 12.

As the slot of the accelerating electrode 23 is deeper, an electron beam incident on the main lens is horizontally elongated, reducing a vertical size of the electron beam. As a result, the influence of deflection aberration is lessened, and the haze phenomenon at the peripheral portion of the screen is suppressed. Meanwhile, repulsive space charge (electric) force is increased, and thus the vertical size of the electron beam is increased. Accordingly, vertically elongated beam spots are created at the central portion of the screen, and spots at the peripheral portion of the screen are less influenced by the haze phenomenon.

However, the above schemes are not sufficient to obtain a satisfactory resolution at the peripheral portion of the screen. Therefore, to manufacture a cathode ray tube having a high resolution, a dynamic voltage with a parabolic waveform is applied, as shown in FIG. 13, to form a dynamic quadrupole lens (DQ lens) as shown in FIG. 14.

However, to apply the dynamic voltage, a separate circuit is needed. This consequently raises the manufacture cost of an electron gun, and lowers price competitiveness of a cathode ray tube.

SUMMARY OF THE INVENTION

An object of the invention is to solve at least the above problems and/or disadvantages and to provide at least the advantages described hereinafter.

Accordingly, one object of the present invention is to solve the above problems by providing a structure of an electron gun for a cathode ray tube, in which resolution is much improved although a dynamic voltage is not applied.

The foregoing and other objects and advantages are realized by providing a cathode ray tube comprising a panel having a fluorescent screen formed on an inner surface, a funnel connected to the panel, an electron gun for emitting electron beams, a deflection yoke for deflecting the electron beams in horizontal and vertical directions, and a shadow mask with a color selecting function, wherein the electron gun comprises a triode unit for generating electron beams; pre-focus lenses for preliminary focusing and accelerating the electron beams generated by the triode unit; and a main lens for finally focusing and accelerating the focused and accelerated electron beams through the pre-focus lenses, and wherein a control electrode forming the triode unit has horizontally elongated electron beam passing holes, and an accelerating electrode forming the triode unit has vertically elongated electron beam passing holes or vertically elongated slots that are formed around the electron beam passing holes.

Another aspect of the present invention provides a cathode ray tube comprising a panel having a fluorescent screen formed on an inner surface, a funnel connected to the panel, an electron gun for emitting electron beams, a deflection yoke for deflecting the electron beams in horizontal and vertical directions, and a shadow mask with a color selecting function, wherein the electron gun comprises a triode unit for generating electron beams; pre-focus lenses for preliminary focusing and accelerating the electron beams generated by the triode unit; and a main lens for finally focusing and accelerating the focused and accelerated electron beams through the pre-focus lenses, and wherein a static voltage is applied to the electron gun, and astigmatism at a center of a screen is greater than 600V.

In the above embodiment of the cathode ray tube, a control electrode forming the triode unit has horizontally elongated electron beam passing holes, and an accelerating electrode forming the triode unit has vertically elongated electron beam passing holes or vertically elongated slots that are formed around the electron beam passing holes. Also, a vertical size of the electron beam passing hole on the control electrode is 40–70% of a horizontal size of the electron beam passing hole, and a horizontal size of the electron beam passing hole on the accelerating electrode is 80–90% of a vertical size of the electron beam passing hole on the accelerating electrode.

Another aspect of the present invention provides a cathode ray tube comprising a panel having a fluorescent screen formed on an inner surface, a funnel connected to the panel, an electron gun for emitting electron beams, a deflection yoke for deflecting the electron beams in horizontal and vertical directions, and a shadow mask with a color selecting function, wherein the electron gun comprises a triode unit for generating electron beams; pre-focus lenses for preliminary focusing and accelerating the electron beams generated by the triode unit; and a main lens for finally focusing and accelerating the focused and accelerated electron beams through the pre-focus lenses, and wherein a static voltage is applied to the electron gun, and a main focus electrode forming the main lens comprises at least two auxiliary electrodes.

Still another aspect of the invention provides a cathode ray tube comprising a panel having a fluorescent screen formed on an inner surface, a funnel connected to the panel, an electron gun for emitting electron beams, a deflection yoke for deflecting the electron beams in horizontal and vertical directions, and a shadow mask with a color selecting function, wherein the electron gun comprises a triode unit for generating electron beams; pre-focus lenses for preliminary focusing and accelerating the electron beams generated by the triode unit; and a main lens for finally focusing and accelerating the focused and accelerated electron beams through the pre-focus lenses, and wherein a static voltage is applied to the electron gun, and a horizontal direction crossover of the electron beams is formed between an accelerating electrode and a first pre-focus electrode or after the first pre-focus electrode, and a vertical direction crossover of the electron beams is formed between a control electrode and the accelerating electrode.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The following detailed description will present a cathode ray tube according to a preferred embodiment of the invention in reference to the accompanying drawings.

Figure 15:
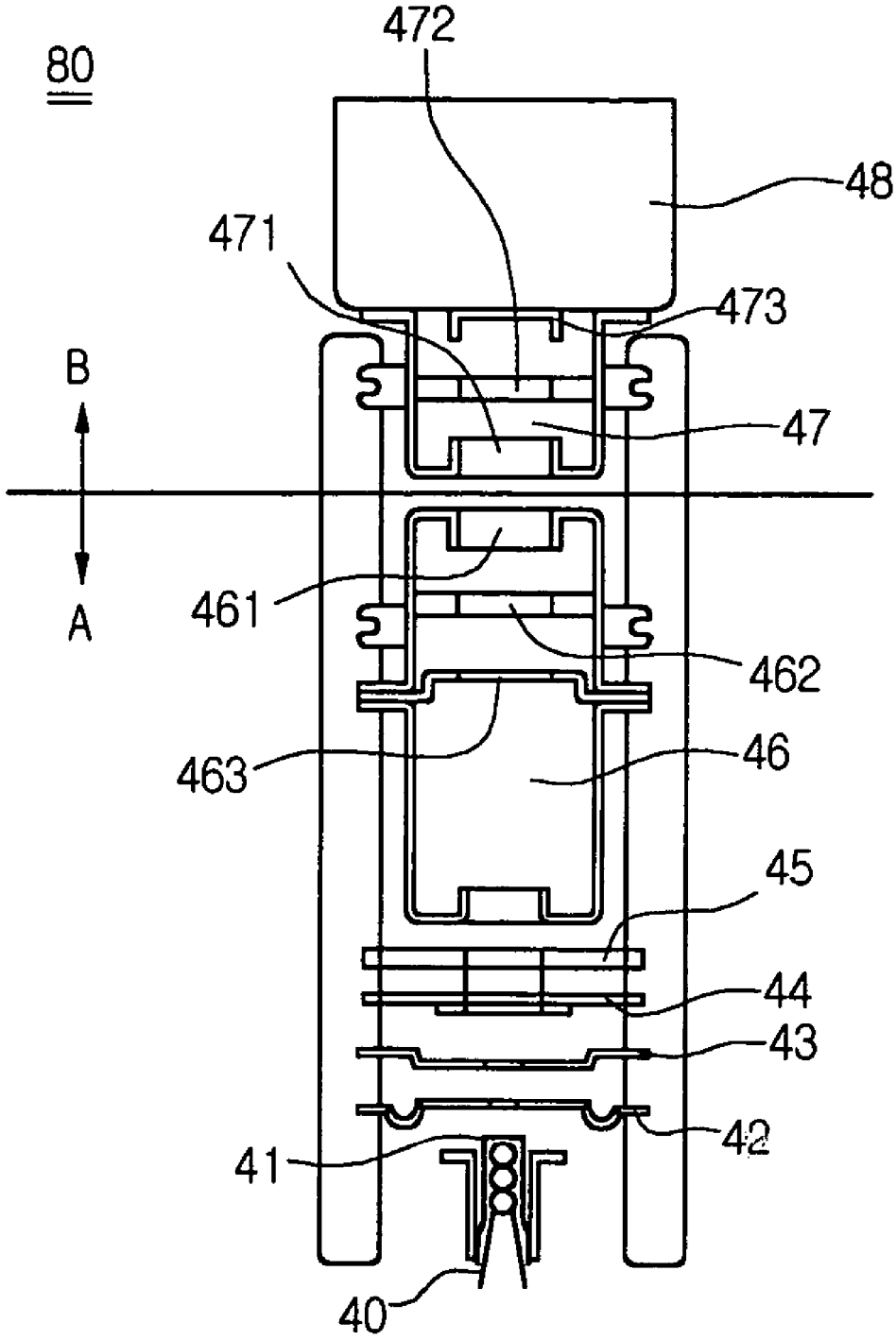
FIG. 15 illustrates a structure of an electron gun for a cathode ray tube according to the present invention.

FIG. 15 illustrates a structure of an electron gun for a cathode ray tube according to the present invention.

Referring to FIG. 15, the electron gun 80 of the present invention is largely divided largely be divided into three parts: a triode unit, a main lens, and a pre-focus lens between the triode unit and the main lens.

The triode unit includes a cathode 41 having a built-in heater 40, a control electrode 42 for controlling electron beams emitted from the cathode 41, and an accelerating electrode 43 for accelerating the electron beams, in which the cathode 41 is arranged in-line.

The main lens includes a main focus electrode 46 and an anode 47 for focusing electron beams generated from the triode unit and accelerating the electron beams in the end. More specifically, the main focus electrode 46 includes a cap electrode 461 having a race track shaped rim portion, and two auxiliary electrodes 462, 463. The anode 47 includes a cup electrode 471 having a race track shaped rip portion, an auxiliary electrode 472, and an anode astigmatism correction electrode 473. Here, the auxiliary electrodes 462, 472 are to equalize convergence force of three electron beams, and recessed to a certain direction from the cap electrode 461 or the cup electrode 471.

The pre-focus lens includes a first pre-focus electrode 44 and a plate-shaped second pre-focus electrode 45.

Unlike the related art in which a dynamic voltage is applied to an electron gun, a static voltage is applied to the electron gun of the invention. More specifically, a voltage of 400–1000V is applied to the accelerating electrode 43 and the second pre-focus electrode 45, respectively. Further, a voltage corresponding to 20–30% of an anode voltage is applied to the first pre-focus electrode 44 and the main focus electrode 46, respectively. Here, the anode voltage ranges from 22 kV to 35 kV.

Figure 16:
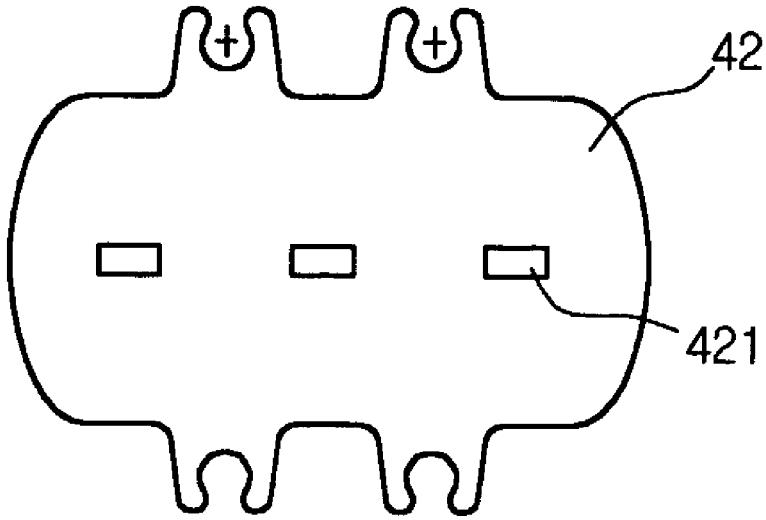
FIG. 16 illustrates a control electrode of an electron gun according to the present invention.
Figure 17:
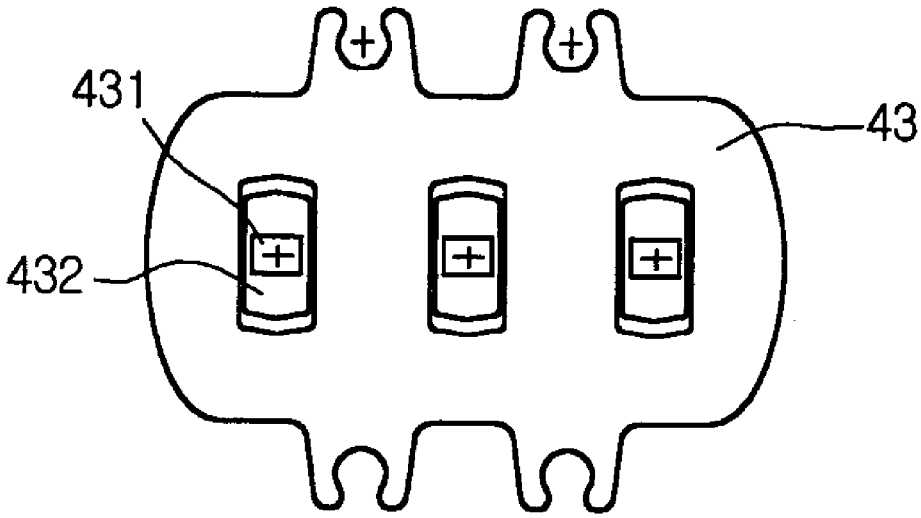
FIG. 17 and FIG. 18 illustrate an accelerating electrode of the present invention.
Figure 18:
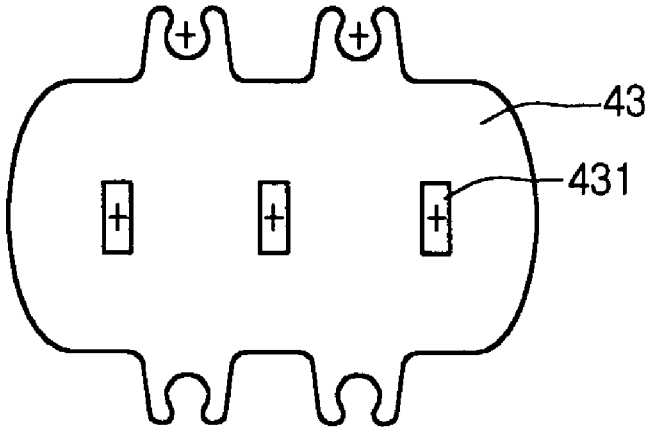

FIG. 16 illustrates the control electrode of the electron gun according to the present invention, and FIG. 17 and FIG. 18 illustrate the accelerating electrode of the present invention.

As shown in FIG. 16, an electron beam passing hole 421 on the control electrode 42 is horizontally elongated. Preferably, the horizontal size of the electron beam passing hole 421 is 0.6–0.8 mm, and the vertical size of the electron beam passing hole 421 is 0.3–0.45 mm. In the embodiment, for example, the horizontal size of the electron beam passing hole 421 is 0.7 mm, and the vertical size thereof is 0.41 mm. A desired vertical size of the electron beam passing hole 421 on the control electrode 42 is 40–70% of the horizontal size of the electron beam passing hole 421.

FIG. 17 illustrates a first embodiment of an accelerating electrode 43. As shown in FIG. 17, the slot 432 formed around the electron beam passing hole 431 on the accelerating electrode 43 is vertically elongated, that is, the vertical size of the slot 432 is grater than the horizontal size thereof.

FIG. 18 illustrates a second embodiment of the accelerating electrode 43, where no slot 432 is formed. As in FIG. 17, the shape of the electron beam passing hole 431 in FIG. 18 is vertically elongated. Preferably, the horizontal size of the electron beam passing hole 431 is 0.56–0.7mm, and the vertical size of the electron beam passing hole 431 is 0.6–0.8mm. In the embodiment, for example, the horizontal size of the electron beam passing hole 431 is 0.64mm, and the vertical size thereof is 0.70mm. A desired horizontal size of the electron beam passing hole 431 on the accelerating electrode 43 is 80–90% of the vertical size of the electron beam passing hole 431. the horizontal size of the electron beam passing hole 431 is 0.64 mm, and the vertical size thereof is 0.70 mm. A desired horizontal size of the electron beam passing hole 431 on the control electrode 43 is 80–90% of the vertical size of the electron beam passing hole 431.

The control electrode 42 and the accelerating electrode 43 have a plate shape.

Figure 19:
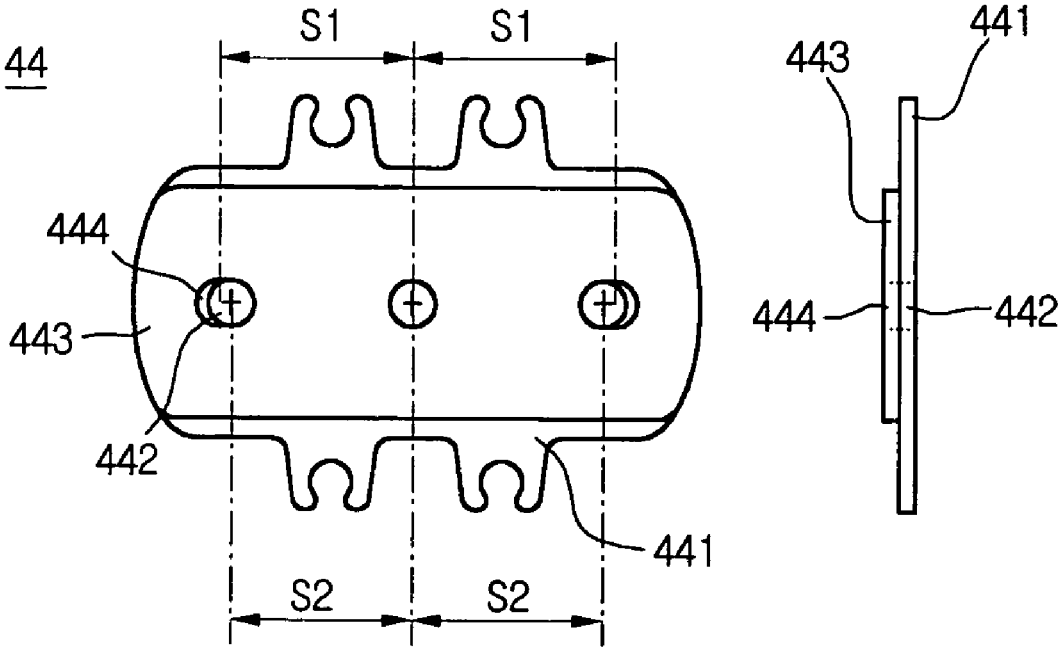
FIGS. 19 to 21 respectively illustrates an exemplary embodiment of a first pre-focus electrode according to the present invention.
Figure 20:
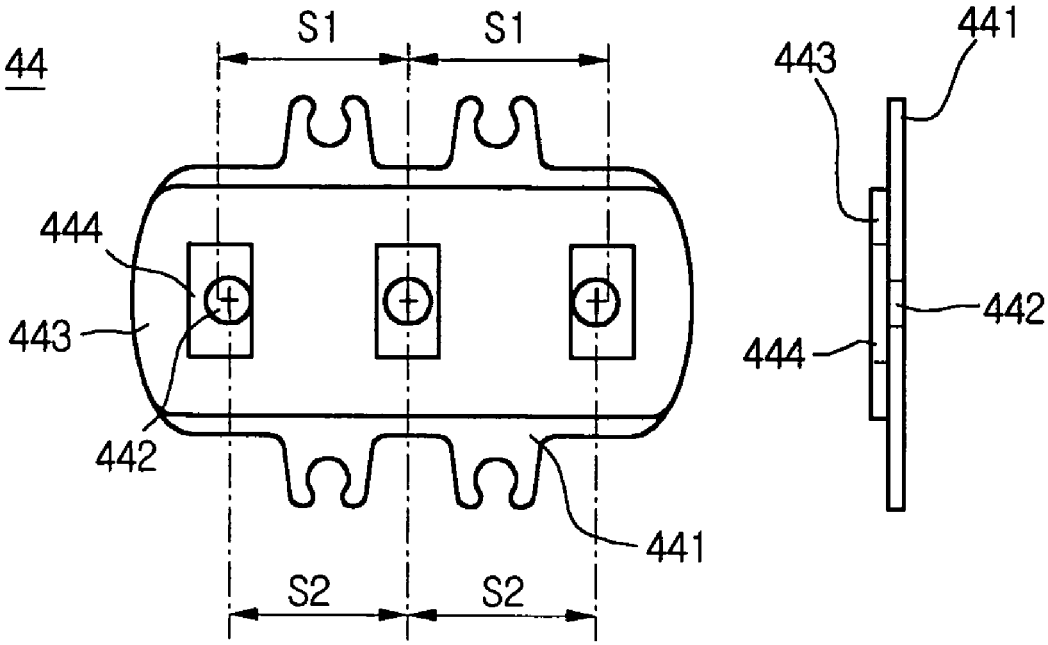
Figure 21:
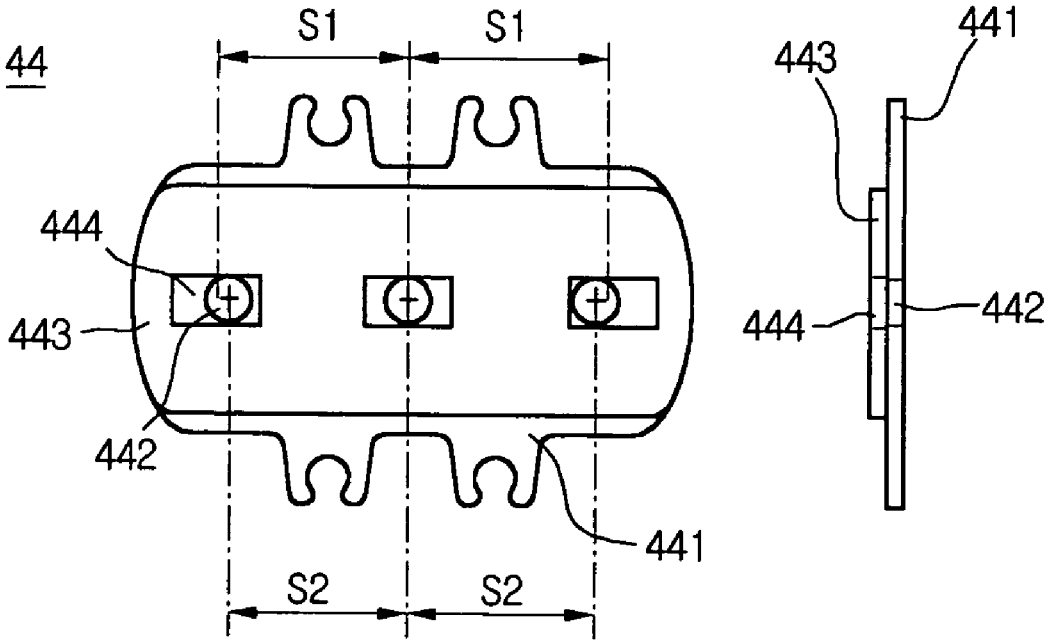

FIGS. 19 to 21 respectively illustrates a front view and a side view of an exemplary embodiment of a first pre-focus electrode according to the present invention.

Referring to FIG. 19, the first pre-focus electrode 44 includes a relatively large electrode 441 having a portion to be laid in a bead glass, and a relatively small electrode 443 that is not laid in the bead glass. An electron beam passing hole 442 formed on the relatively large electrode 441 has a circular shape, and the diameter thereof is 0.9–1.5 mm. The relatively small electrode 443 is located toward the accelerating electrode 43.

An outside electron beam passing hole of the electron beam passing hole 444 formed on the relatively small electrode 443 is horizontally elongated.

A distance (S1) from the center of a central electron beam passing hole on the small electrode 443 to the center of an outside electron beam passing hole on the small electrode 443 is greater than a distance (S2) from the center of a central electron beam passing hole on the large electrode 441 to the center of an outside electron beam passing hole on the large electrode 441. This is because to adjust electron beams to be incident upon the center of main lens.

FIG. 20 illustrates a second embodiment of the first pre-focus electrode 44. As discussed already with reference to FIG. 19, the distance (S1) from the center of a central electron beam passing hole on the small electrode 443 to the center of an outside electron beam passing hole on the small electrode 443 is greater than a distance (S2) from the center of a central electron beam passing hole on the large electrode 441 to the center of an outside electron beam passing hole on the large electrode 441. The electron beam passing hole formed on the small electrode 443 is vertically elongated. Preferably, a horizontal size of the electron beam passing hole is 1.0–2.0 mm, and a vertical size thereof is 2.0–4.0 mm.

FIG. 21 illustrates a third embodiment of the first pre-focus electrode 44. In this embodiment, the horizontal size of the electron beam passing hole formed on the small electrode 443 is greater than the vertical size thereof. A desired horizontal size of the electron beam passing hole is less than 2.0 mm.

In the first embodiment shown in FIG. 19, the electron beam passing hole formed on the large electrode 441 is a 1.1 mm diameter circle. The central electron beam passing hole on the small electrode 443 is a 1.1 mm diameter circle, while the outside electron beam passing hole on the small electrode 443 is 1.2 mm in horizontal size and 1.1 mm in vertical size.

In the second embodiment shown in FIG. 20, the electron beam passing hole formed on the large electrode 441 is a 1.1 mm diameter circle. Meanwhile, the electron beam passing hole on the small electrode 443 is a 1.5 mm in horizontal size and 3.2 mm in vertical size.

In the third embodiment shown in FIG. 21, the electron beam passing hole formed on the large electrode 441 is a 1.1 mm diameter circle. On the other hand, the electron beam passing hole on the small electrode 443 is a 1.8 mm in horizontal size and 1.1 mm in vertical size.

Although the first pre-focus electrode 44 illustrated in FIGS. 19 to 21 is divided into the large electrode 441 and the small electrode 443, it is also possible to make them into one body.

Preferably, thicknesses of the first pre-focus electrode 44, the control electrode 42, and the accelerating electrode 43 satisfy a relation of the control electrode 42<the accelerating electrode 43<the first pre-focus electrode 44.

FIGS. 22 to 28 respectively illustrates an exemplary embodiment of a second pre-focus electrode according to the present invention.

Figure 22:
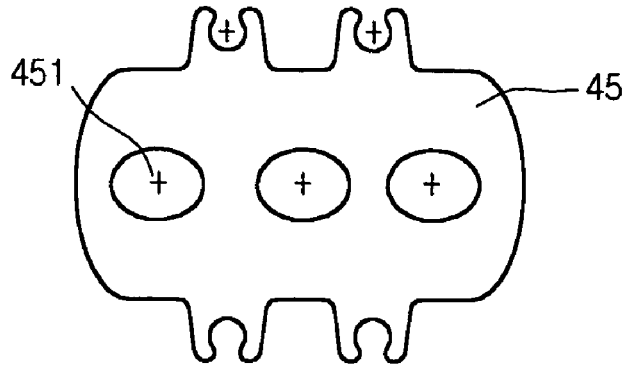
FIGS. 22 to 28 respectively illustrates an exemplary embodiment of a second pre-focus electrode according to the present invention.
Figure 23:
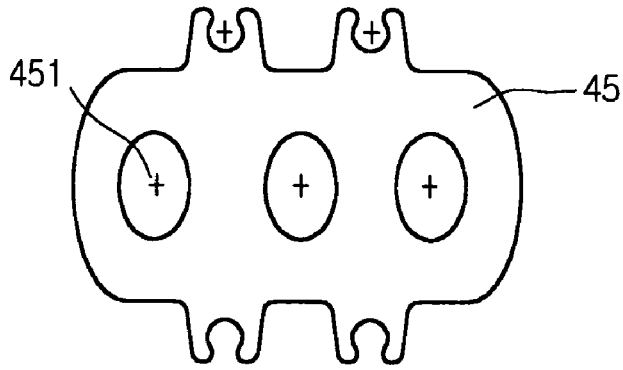

As described before, the second pre-focus electrode 45 is a pre-focus lens forming electrode. FIG. 22 illustrates a horizontally elongated electron beam passing hole 451, and FIG. 23 illustrates a vertically elongated electron beam passing hole 451.

For a proper alignment of electrodes during the assembly of an electron gun, each of the electrodes should be supported. In case of the second pre-focus electrodes 45 illustrated in FIGS. 22 and 23, since the pre-focus electrodes have an oval shape, it is not easy to support the electrode even by using a support called "Mandrel". Accordingly, instead of supporting the electrode through the electron beam passing hole 451, an outer surface of the electrode is used to support the electrode.

FIGS. 24 to 27 respectively illustrates a second pre-focus electrode 45 that is supported through an electron beam passing hole 451 by using Mandrel. In case of the second pre-focus electrode 45 shown in FIGS. 24 and 25, the electron beam passing hole on each electrode, although not a perfect circle, has a circle shape in both horizontal and vertical directions, where either horizontal size or vertical size of the passing hole is shorter than the other. For the alignment of the electrode, Mandrel comes in touch with the shorter arc of the circle. In case of an electron beam passing hole formed on the second pre-focus electrode 45 shown in FIGS. 26 and 27, only one of the horizontal and vertical directions forms a circular arc, and the other part of the passing hole is straight line. Therefore, when the Mandrel whose cross-section is circular is cut in one of the horizontal and vertical directions, it can make contact with the electron beam passing hole 451 from every direction. As a result, the alignment of the electrode can be successfully done.

Figure 28:
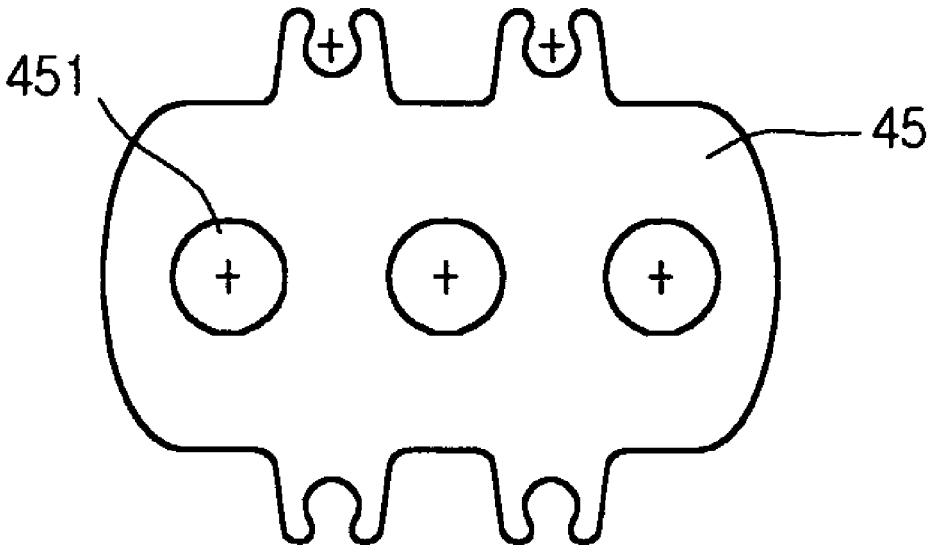

FIG. 28 illustrates yet another embodiment of the second pre-focus electrode 45, in which an electron beam passing hole 451 has a circular shape to secure landing margin of an electron beam.

Figure 29:
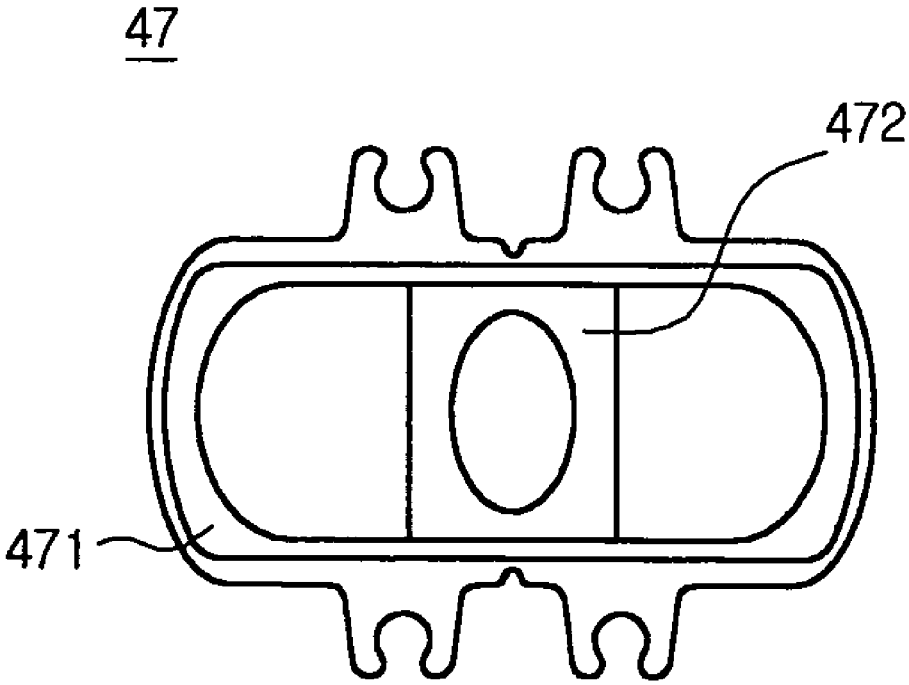
FIG. 29 illustrates an anode in the present invention.

FIG. 29 illustrates an anode 47 seen from 'B' direction in FIG. 15. The anode 47 includes a cup electrode 471 having a race track shaped rim portion, an auxiliary electrode 472, and an anode astigmatism correction electrode 473 (shown in FIG. 30). Here, the auxiliary electrode 472 includes an electron beam passing hole, and is recessed to a certain direction from the cup electrode 471. The anode astigmatism correction electrode 473 is attached to a shied cup 48 as shown in FIG. 31, and disposed at the top and bottom parts of electron beam passing holes 4731 in a form of plate.

Figure 32:
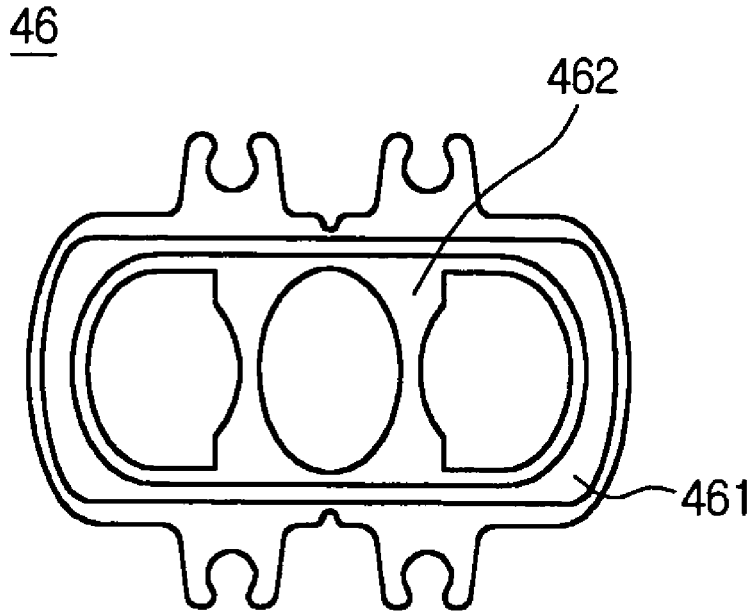
FIG. 32 illustrates a main focus electrode in the present invention.

FIG. 32 illustrates a main focus electrode 46 seen from 'A' direction in FIG. 15. The main focus electrode 46 includes a cap electrode 461 having a race track shaped rim portion, and more than two auxiliary electrodes 462, 463. The auxiliary electrode 462 serves to equalize convergence forces of three electron beams, and is recessed to a certain direction from the cap electrode 461. Another auxiliary electrode 463 shown in FIG. 33 serves to correct astigmatism. To this end, the auxiliary electrode 463 is inserted to the main focus electrode 46. An electron beam passing hole 4631 formed on this auxiliary electrode 463 is vertically elongated. For example, the electron beam passing hole on the auxiliary electrode 463 shown in FIG. 33 has a keyhole shape.

The operation of an electron gun is now described below.

Figure 34:
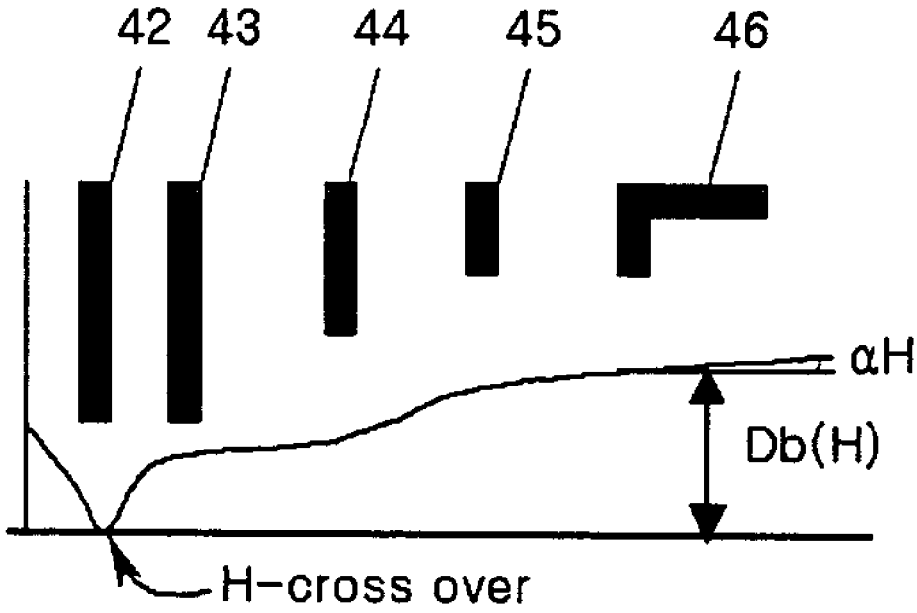
Fig.34 Related Art
FIG. 34 illustrates electron beam diameters in horizontal and vertical directions of an electron gun according to the related art.
Figure 34:
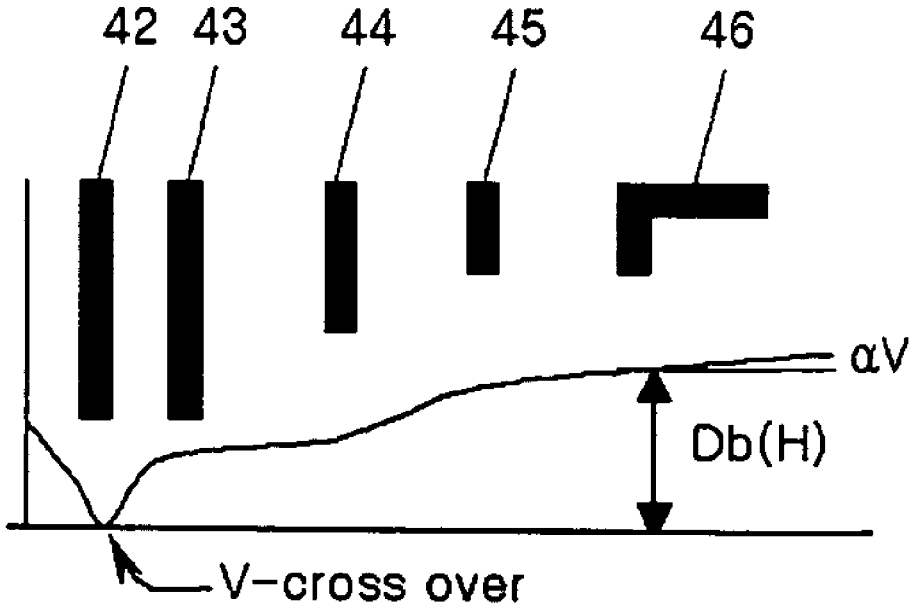
Fig.34 Related Art
Figure 35:
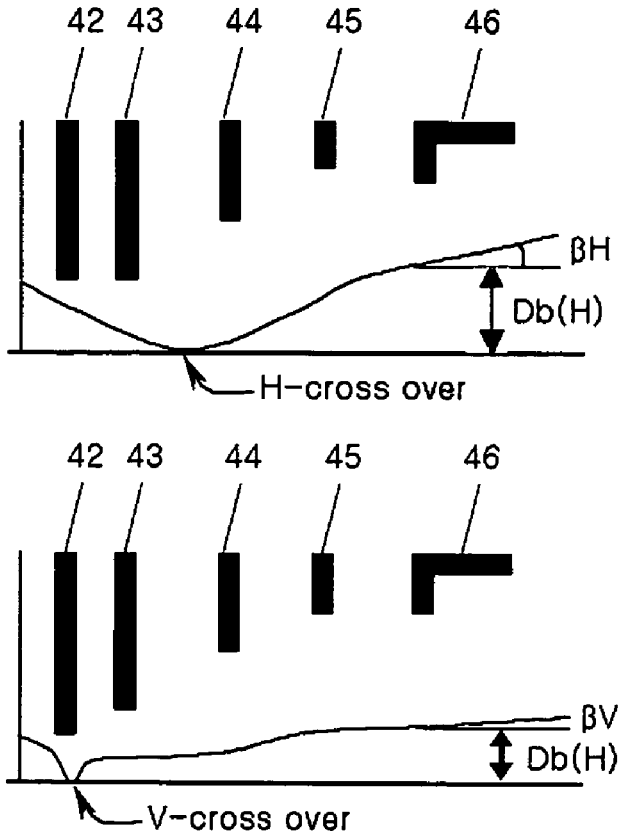
FIG. 35 illustrates electron beam diameters in horizontal and vertical directions of an electron gun according to the present invention.

FIG. 34 illustrates electron beam diameters in horizontal and vertical directions of an electron gun according to the related art, and FIG. 35 illustrates electron beam diameters in horizontal and vertical directions of an electron gun according to the present invention.

Figure 11:
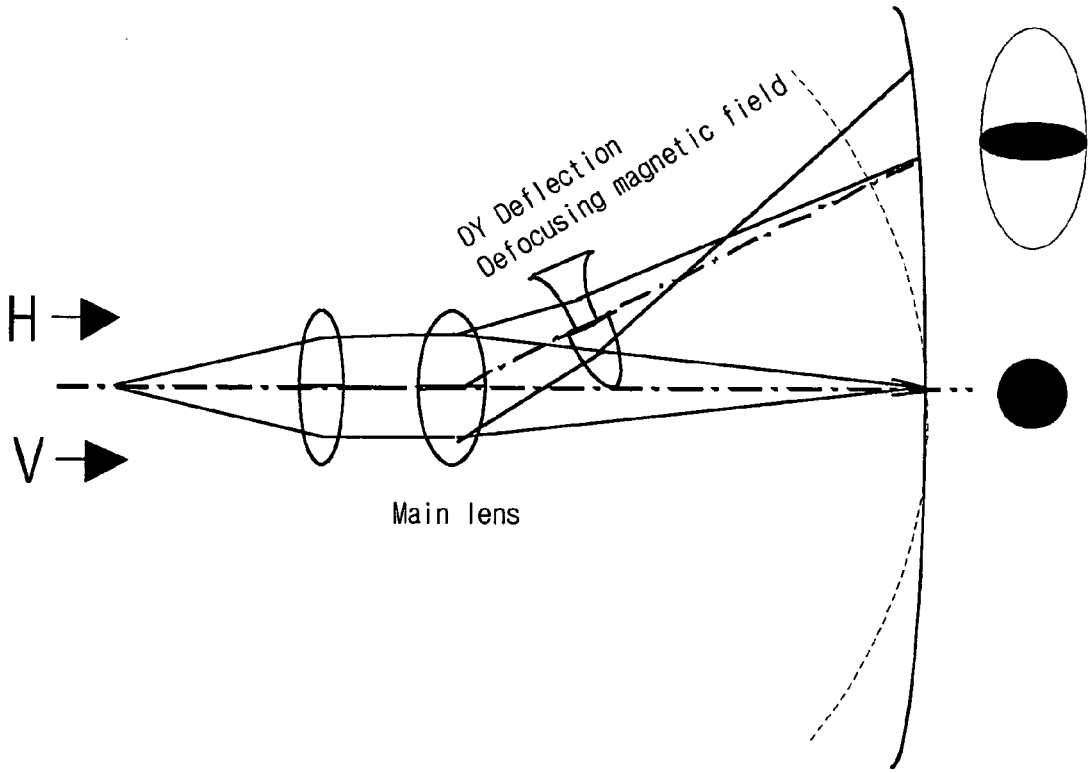
Fig.11 Related Art
FIG. 11 illustrates a shape of an electron beam spot influenced of astigmatism in an electron gun of the related art.
Figure 12:
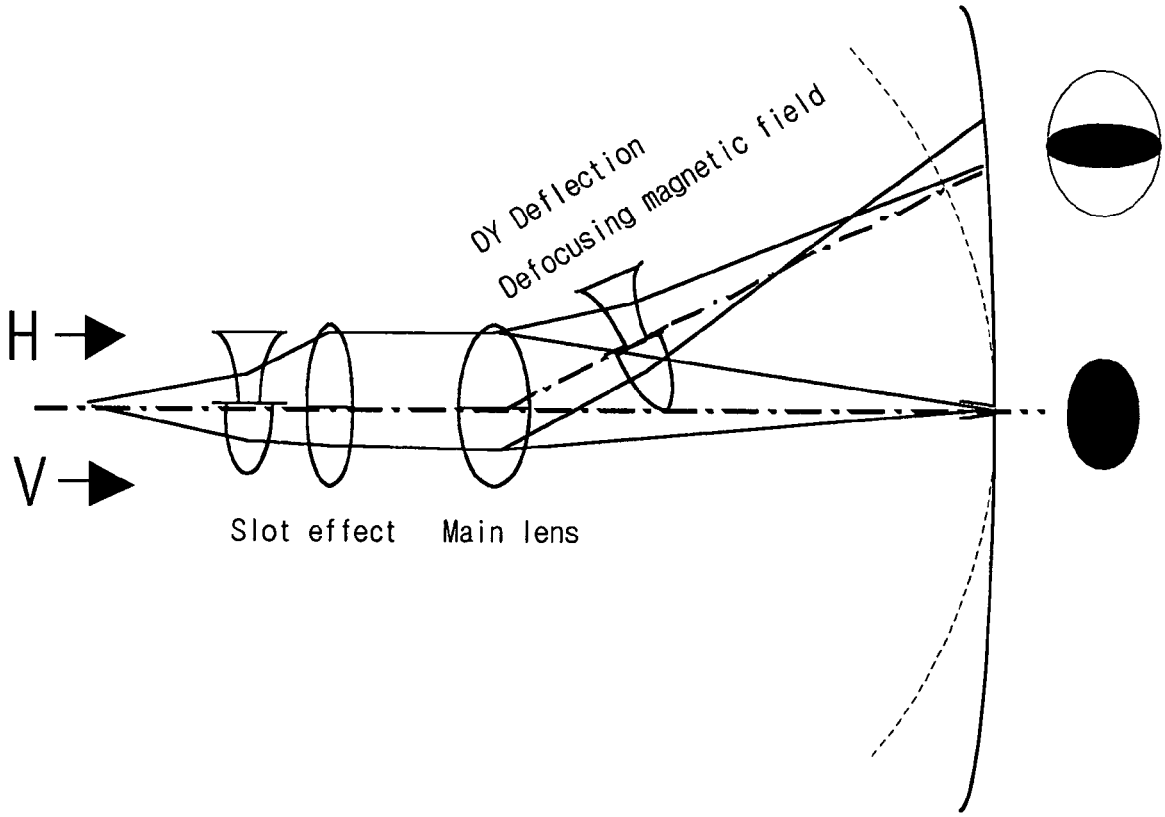
Fig. 12 Related Art
FIG. 12 illustrates a shape of an electron beam spot with the presence of a slot formed on an accelerating electrode of an electron gun of the related art.
Figure 13:
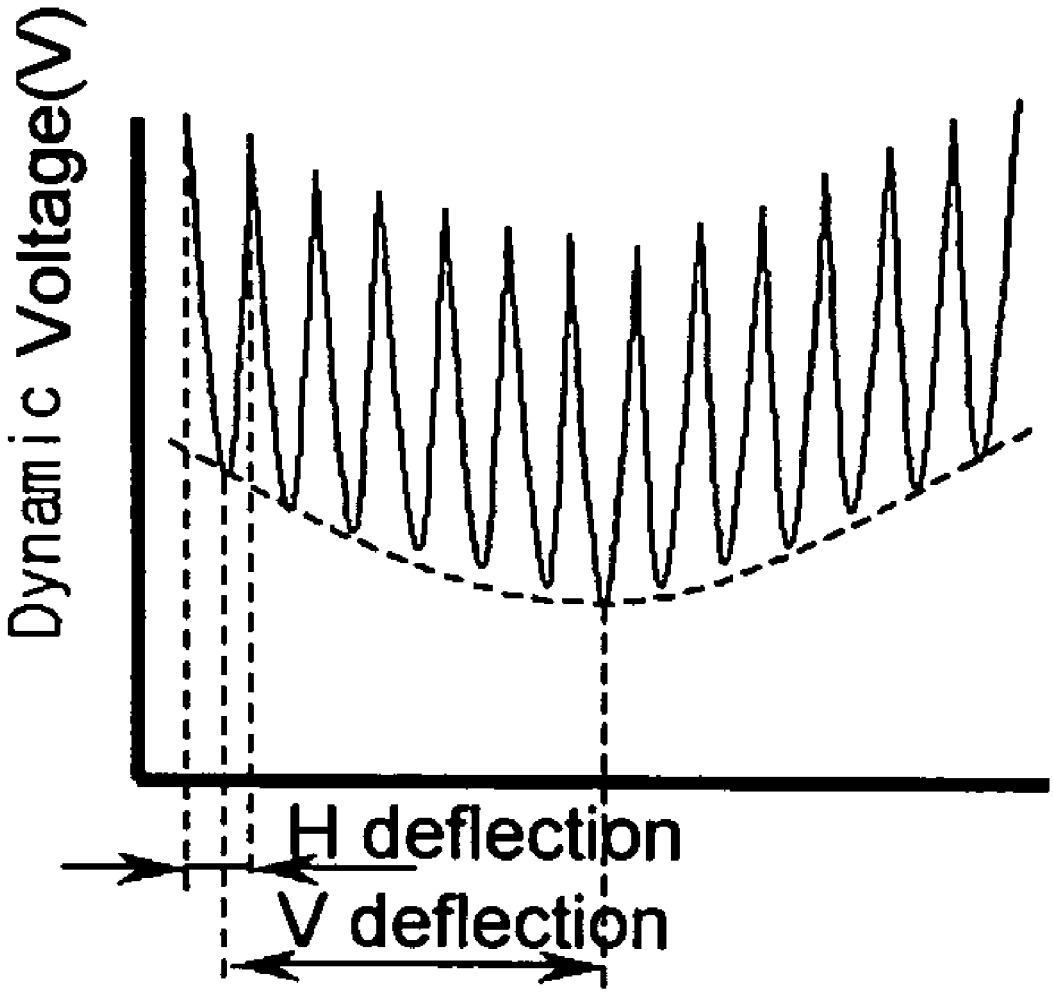
Fig. 13 Related Art
FIG. 13 illustrates a dynamic parabolic waveform that is produced according to the related art.
Figure 14:
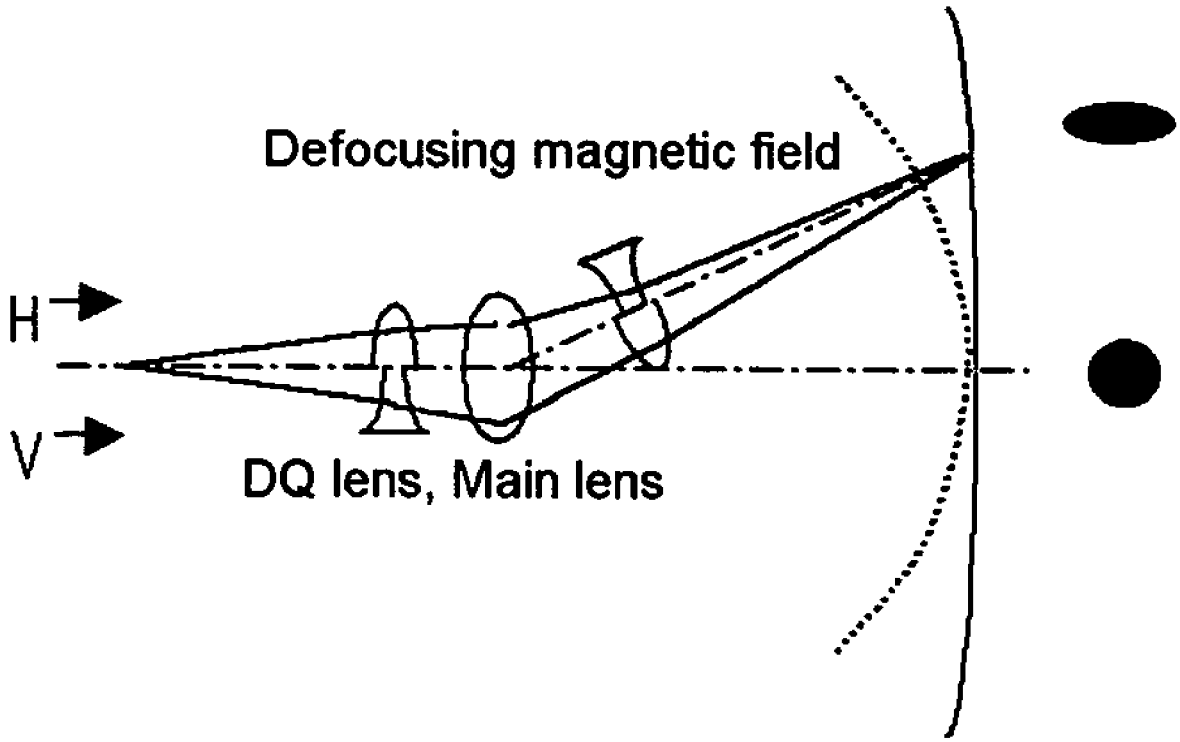
Fig. 14 Related Art
FIG. 14 illustrates how a shape of an electron beam spot changes in accordance with the formation of a dynamic quadrupole lens in the related art.

As mentioned before with reference to FIGS. 11 and 12, it is necessary to design electron beam passing holes in such a manner that the electron beam passing holes are less influenced by deflection aberration, to improve the haze phenomenon at the peripheral portion of the screen. To this end, a vertical size of an electron beam should be less than a horizontal size thereof, especially where deflection magnetic field is working.

Figure 1:
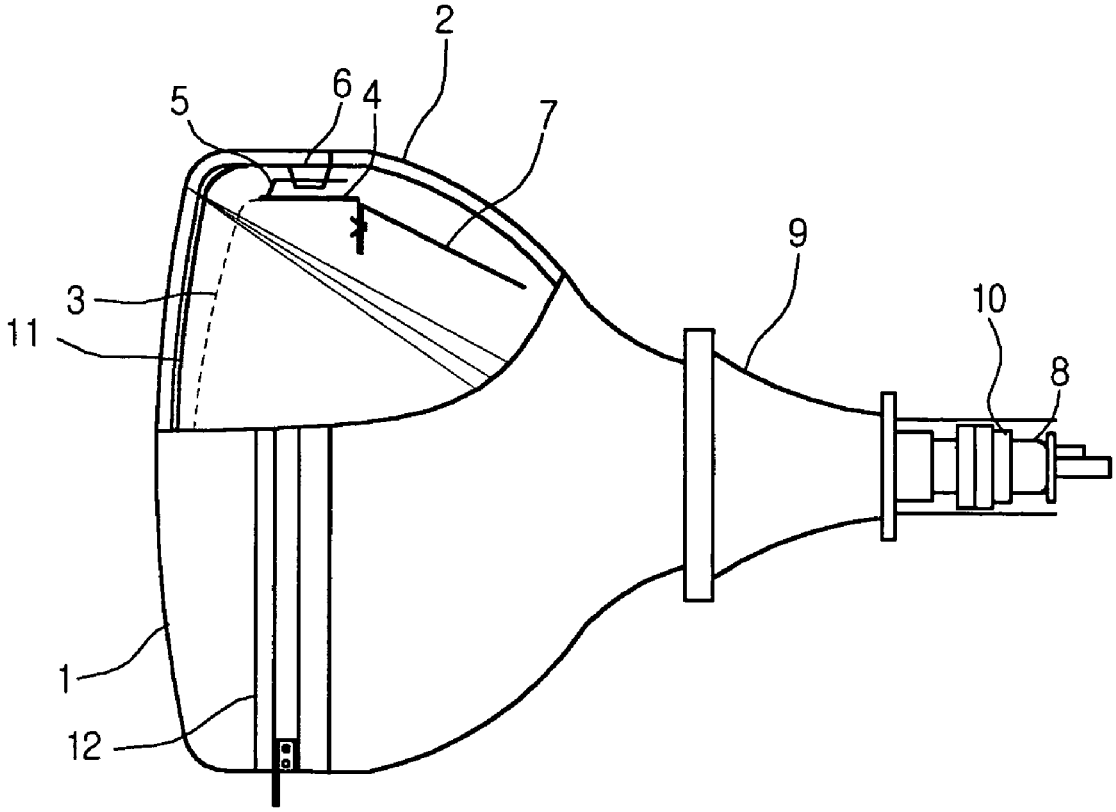
Fig.1 Related Art
FIG. 1 illustrates a structure of a cathode ray tube of the related art.
Figure 2:
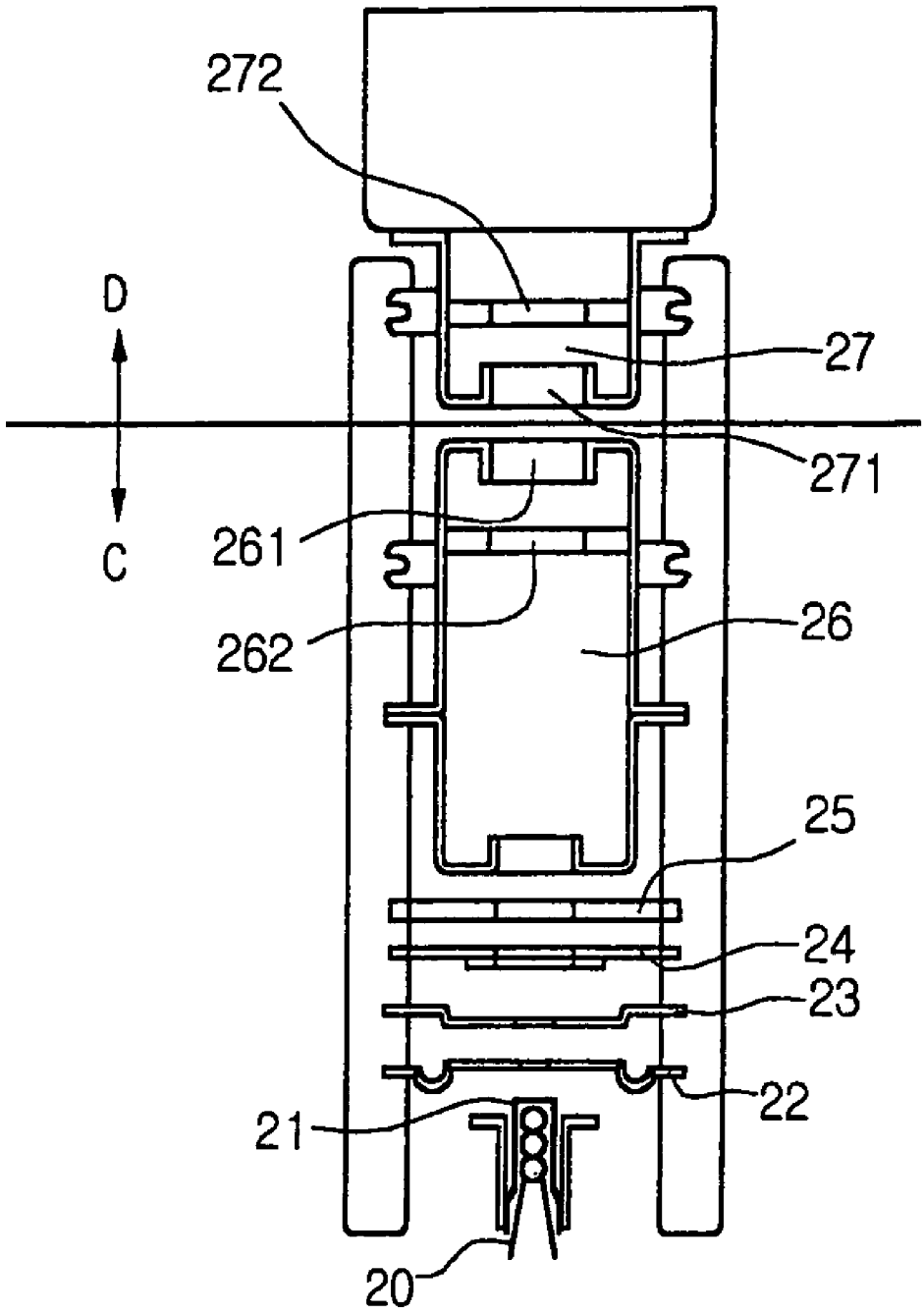
Fig.2 Related Art
FIG. 2 illustrates a structure of an electron gun of the related art.
Figure 3:
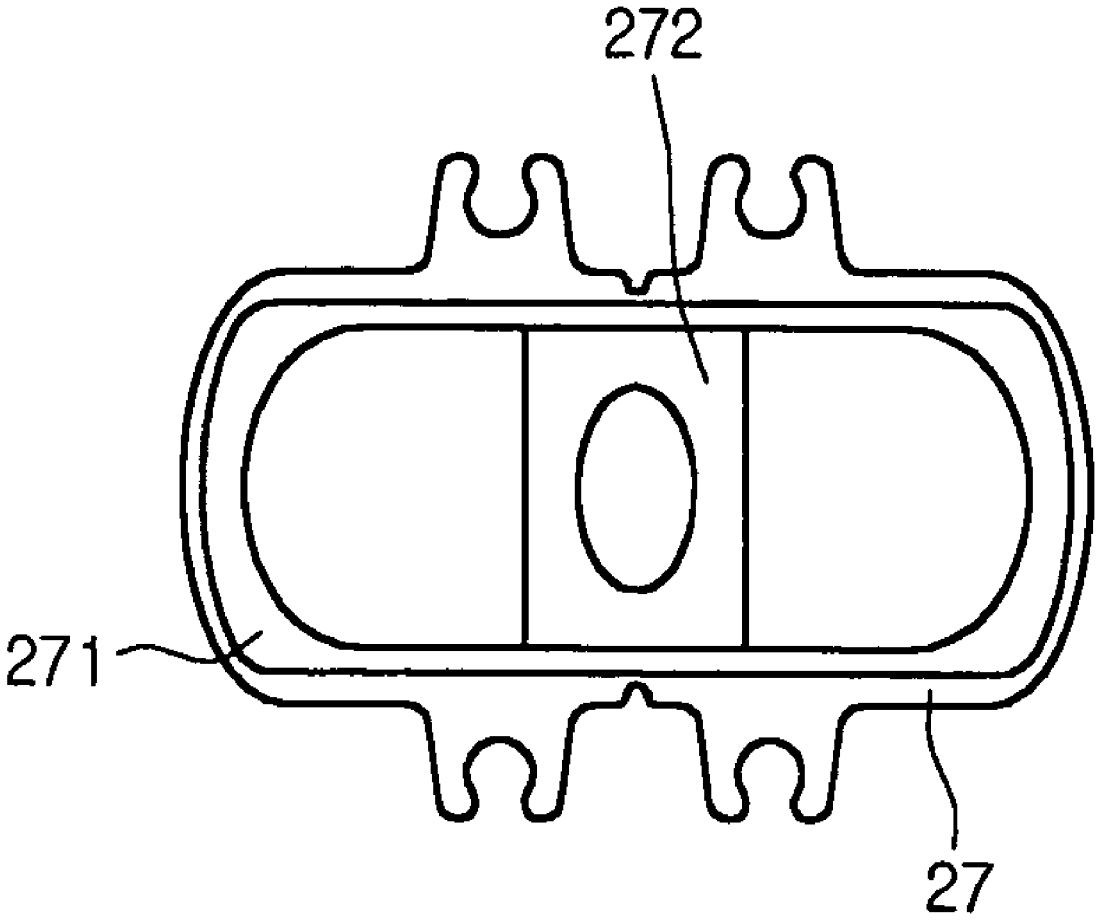
Fig.3 Related Art
FIG. 3 illustrates an anode of an electron gun of the related art.
Figure 4:
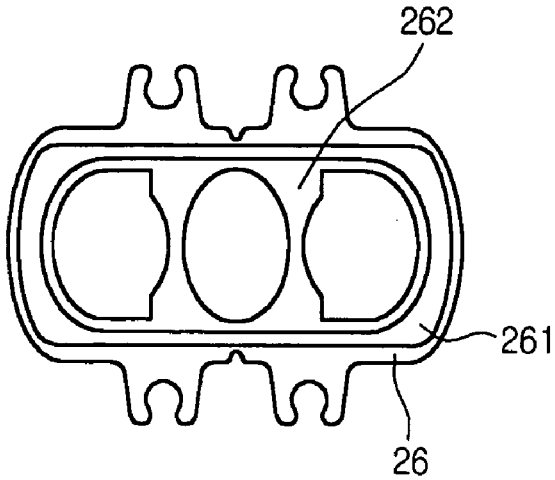
Fig.4 Related Art
FIG. 4 illustrates a main focus electrode of an electron gun of the related art.
Figure 5:
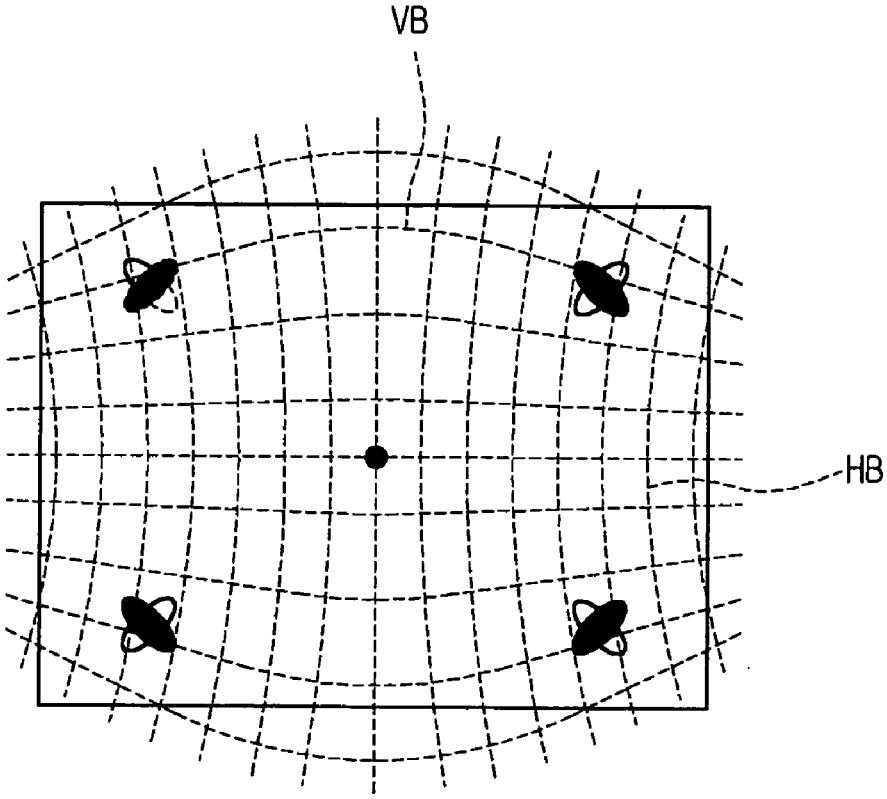
Fig.5 Related Art
FIG. 5 illustrates a magnetic field distribution of a self-convergence type deflection yoke.
Figure 6:
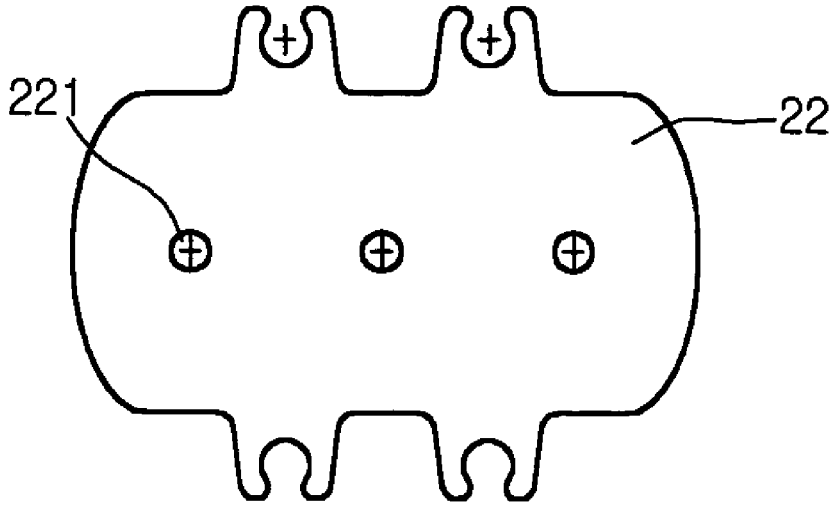
Fig.6 Related Art
FIG. 6 illustrates a control electrode of an electron gun of the related art.
Figure 7:
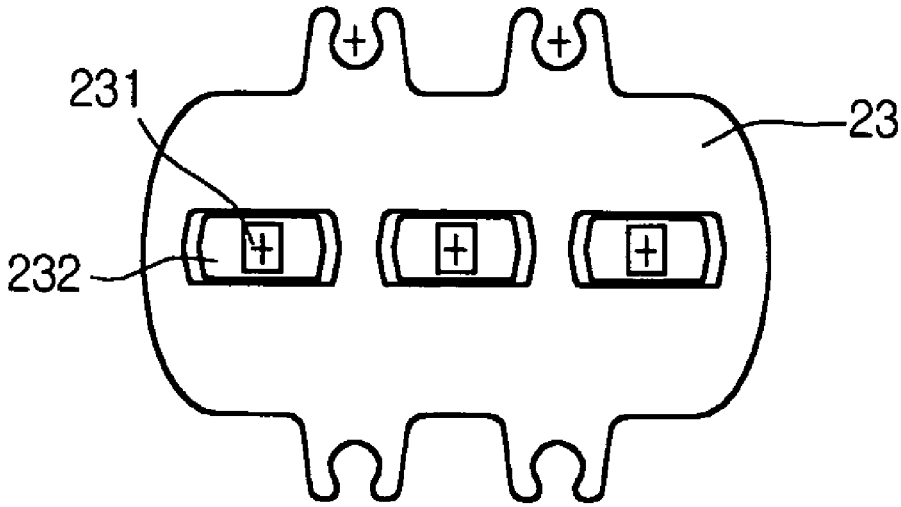
Fig.7 Related Art
FIG. 7 illustrates an accelerating electrode of an electron gun of the related art.
Figure 8:
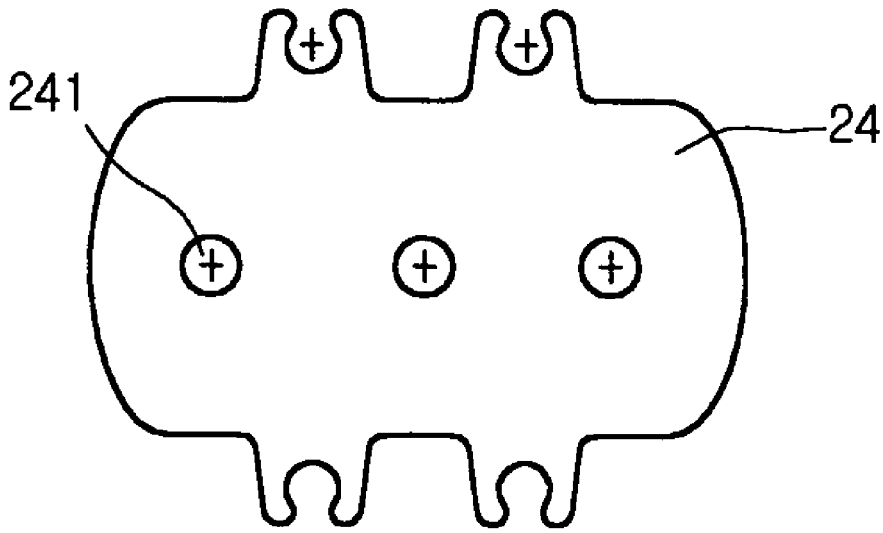
Fig.8 Related Art
FIG. 8 illustrates a first pre-focus electrode of an electron gun of the related art.
Figure 9:
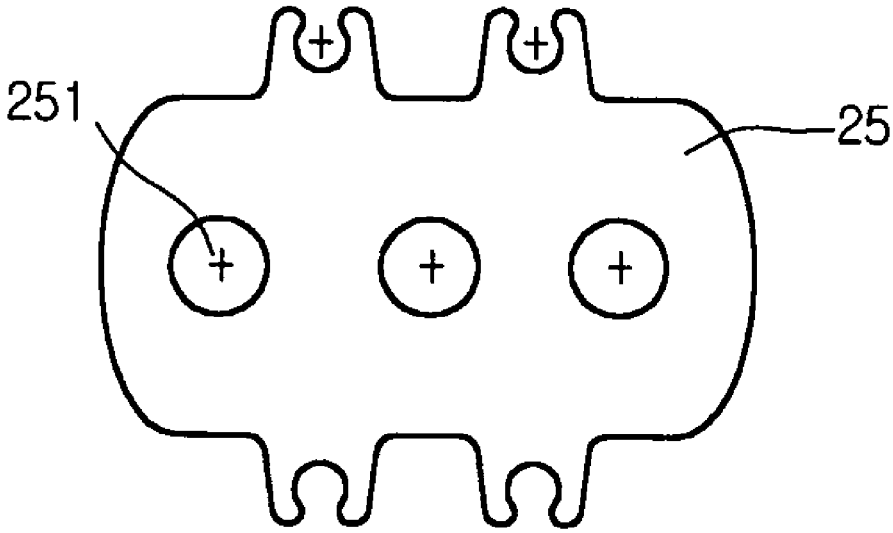
Fig.9 Related Art
FIG. 9 illustrates a second pre-focus electrode of an electron gun of the related art.
Figure 10:
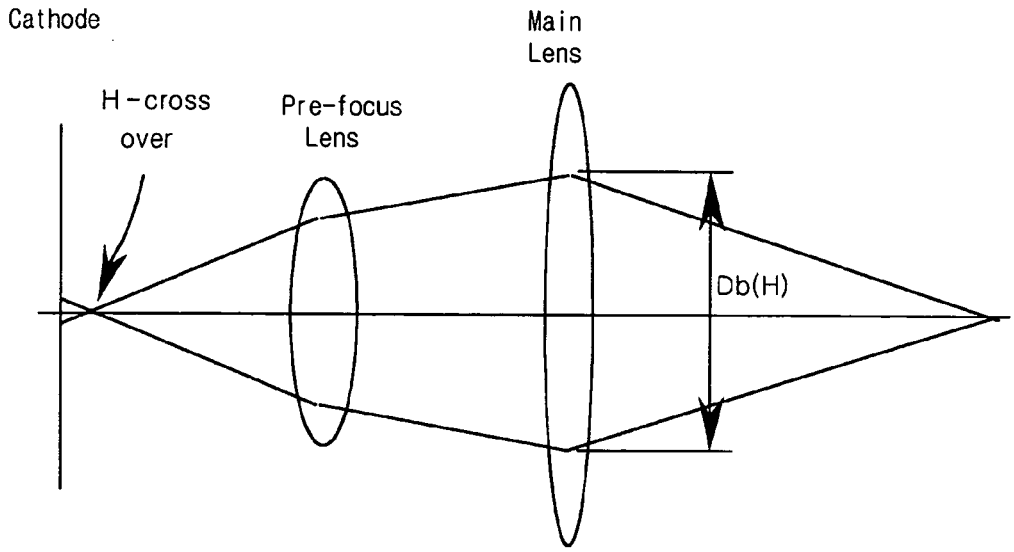
Fig.10 Related Art
FIG. 10 illustrates a size of an electron beam incident on a main lens according to the related art.
Figure 10:
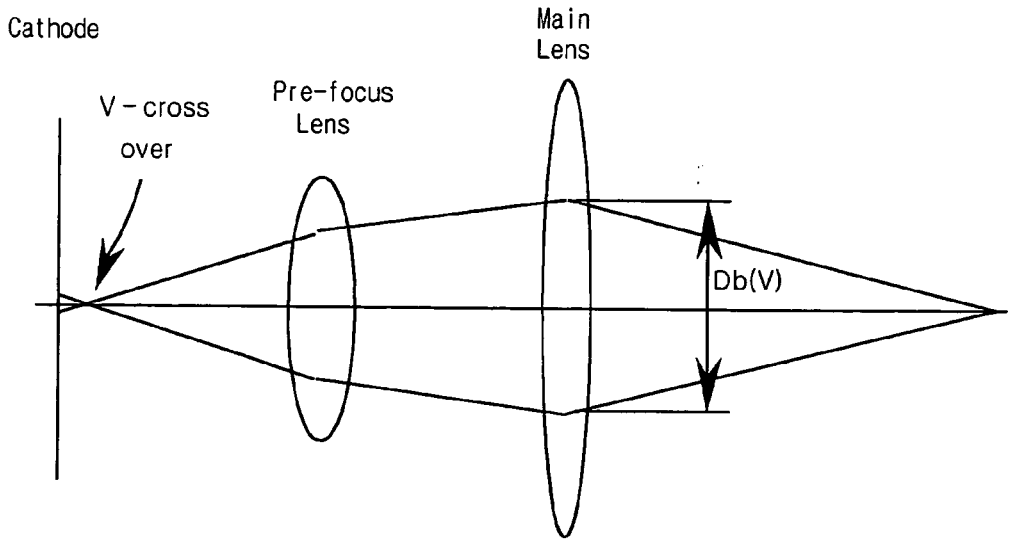
Fig.10 Related Art

Accordingly, the vertical size of an electron beam, Db (V), on the main lens should be reduced as much as possible while maintaining the same horizontal size of the electron beam, Db (H), with one in the related art shown in FIG. 10.

Figure 36:
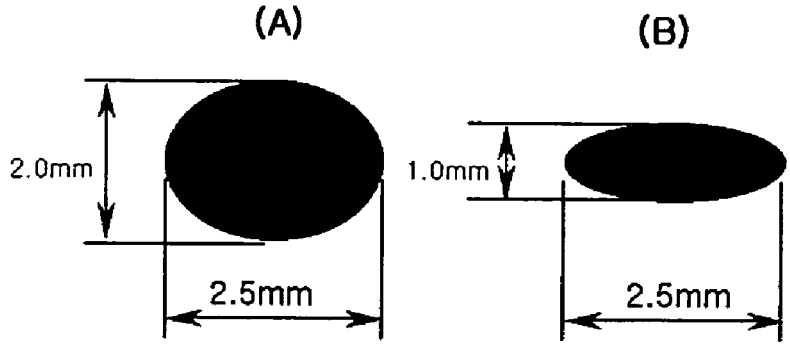
FIG. 36 illustrates electron beam diameters at a main lens of the present invention.
Figure 37:
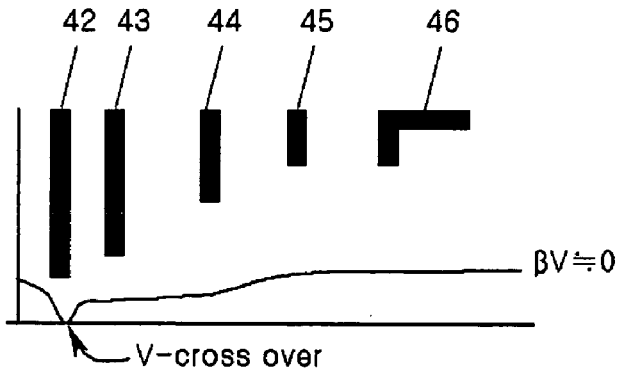
FIG. 37 illustrates a divergence angle of an electron beam in a vertical direction according to the present invention.

In case of a related art electron gun in FIG. 34, positions of cross over in the horizontal and vertical directions are between a control electrode 42 and an accelerating electrode 43. The divergence angle of an electron beam before incidenting on a main lens is $\alpha H$ in the horizontal direction, and αV in the vertical direction. In this type of related art electron gun, an electron beam diameter on the main lens is 2.5 mm in the horizontal direction, and 2.0 mm in the vertical direction, as shown in FIG. 36(A).

According to the present invention, however, as FIG. 35 shows, a crossover of an electron beam in the horizontal direction (i.e. H-crossover) is formed between an accelerating electrode 43 and a first pre-focus electrode 44, or after the first pre-focus electrode 44. Meanwhile, a crossover of the electron beam in the vertical direction (i.e. V-crossover) is situated between a control electrode 42 and an accelerating electrode 43, as in the related art.

To have the H-crossover between the accelerating electrode 43 and the first pre-focus electrode 44, as discussed with reference to FIG. 16, the electron beam passing hole 461 should be horizontally elongated.

Also, as mentioned before with reference to FIG. 11, the vertical beam diameter, Db (V), should be reduced to suppress the haze phenomenon in the vertical direction at the peripheral portion of the screen. To this end, the slot 432 around the electron beam passing hole 431 formed on the accelerating electrode 43 should be vertically elongated, as illustrated in FIG. 17. If there is no slot 432, the electron beam passing hole 431 on the accelerating electrode 43 should be vertically elongated, as illustrated in FIG. 18.

When the control electrode 42 and the accelerating electrode 43 are formed as above, the vertical electron beam diameter, Db (V), is reduced while the horizontal electron beam diameter, Db (H), is increased.

In the meantime, in order to reduce spherical aberration of electron beams in the horizontal direction, Db(H) should also be reduced. To this end, the pre-focus lens should be reinforced, centering the second pre-focus electrode 45. This is accomplished by increasing a gap between the first pre-focus electrode 44 and the second pre-focus electrode 45 and between the second pre-focus electrode 45 and the main focus electrode 46, respectively.

Accordingly, when the H-crossover of the electron beam is formed between the accelerating electrode 43 and the first pre-focus electrode 44, the divergence angle of the electron beam before incidenting on the main lens is βH in the horizontal direction and βV in the vertical direction, as shown in FIG. 35.

Comparing the divergence angle of the present invention with one in the related art of FIG. 34, $\beta H > \alpha H$, and $\beta V < \alpha V$.

In addition, the electron beam diameter at the main lens is 2.5 mm in the horizontal direction and 1.0 mm in the vertical direction. Particularly, the vertical electron beam diameter showed 50% of decrease from that of the related art electron gun shown in FIG. 35(A).

The vertical electron beam diameter can be reduced even further to improve deflection aberration, and additional methods can be employed to resolve the haze phenomenon at the peripheral portion of the screen.

Figure 24:
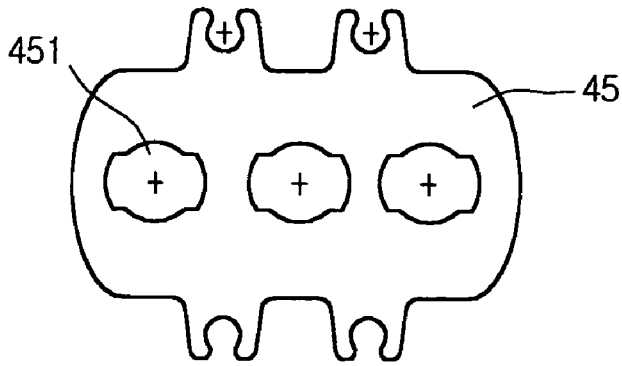
Figure 26:
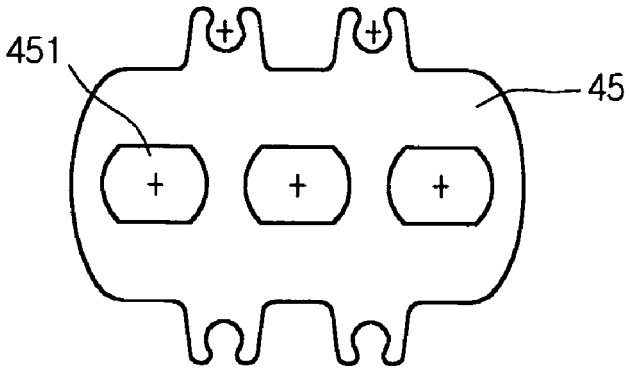

When the electron beam passing hole 451 formed on the second pre-focus electrode 45 is horizontally elongated as illustrated in FIG. 22, FIG. 24 and FIG. 26, electron beams are less converged in the horizontal direction but more converged in the vertical direction, resulting in the reduction of Db (V).

Moreover, by increasing the gap between the first pre-focus electrode 44 and the second pre-focus electrode 45, and the gap between the second pre-focus electrode 45 and the main focus electrode 46, it is possible to reduce Db (V) even more, while maintaining Db (H) to be same with one in the related art. Preferably, the gap between the first pre-focus electrode 44 and the second pre-focus electrode 45 and the gap between the second pre-focus electrode 45 and the main focus electrode 46 are in a range of 1.05 mm–1.4 mm, respectively.

Therefore, when the electron beam passing hole 451 on the second pre-focus electrode 45 is horizontally elongated, the vertical direction divergence angle (βV) of the electron beam before incidenting on the main lens becomes almost 0 degree, thereby being a parallel electron beam.

Figure 38:
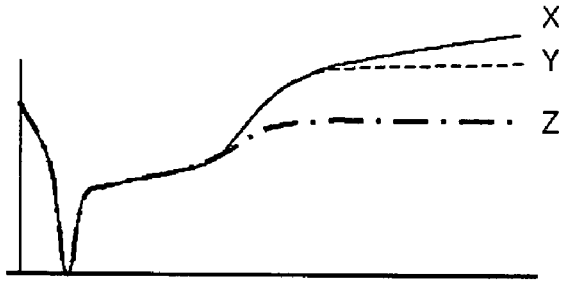
FIG. 38 illustrates an electron beam diameter depending on a shape of a second pre-focus electrode according to the present invention.

Now referring to FIG. 38, X denotes Db (V) of a circular electron beam passing hole 451 on a second pre-focus electrode 45, and Y denotes Db (V) of a horizontally elongated electron beam passing hole 451 on the second pre-focus electrode 45.

As aforementioned with reference to FIG. 20, when the electron beam passing hole 444 on the relatively small electrode 443 of the first pre-focus electrode 44 is vertically elongated, Db (V) can be reduced to Z in FIG. 38.

Hence, the haze phenomenon at the peripheral portion of the screen is more effectively resolved.

Figure 39:
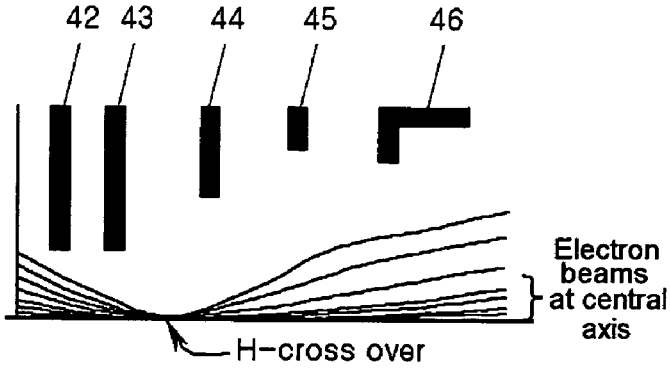
FIG. 39 illustrates a phenomenon in which electron beams are converged to a central axis according to the present invention.
Figure 40:
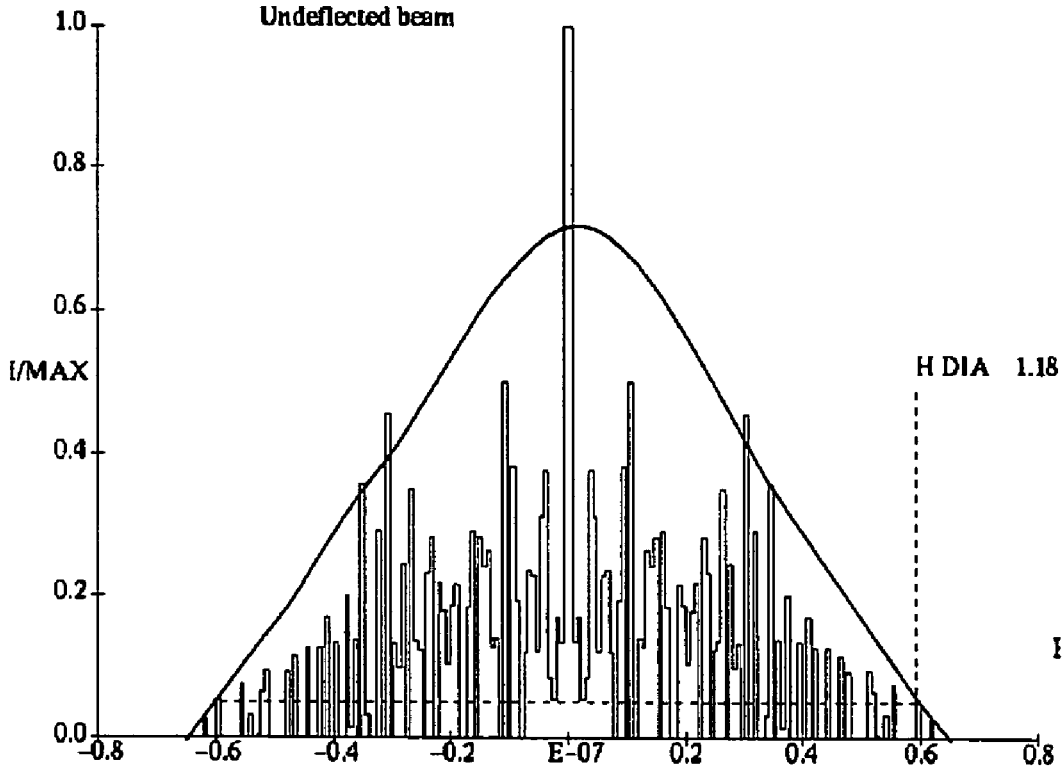
FIG. 40 illustrates a distribution of electron beams before incidenting on a main lens according to the present invention.
Figure 41:
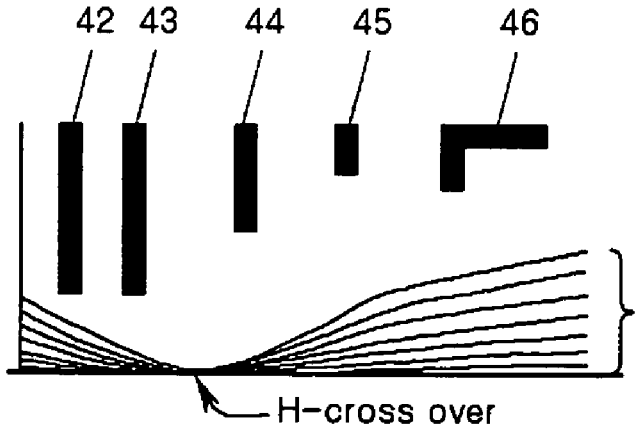
FIG. 41 and FIG. 42 illustrate uniformly distributed electron beams before incidenting on a main lens according to the present invention.
Figure 42:
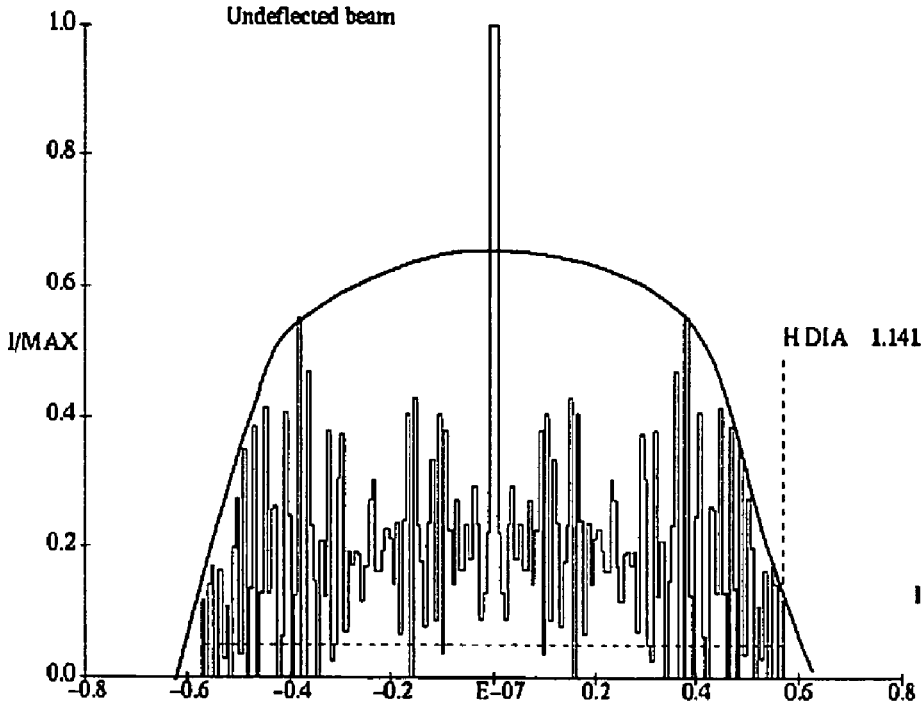

Having the above structure, the H-crossover of an electron beam is formed between the accelerating electrode 43 and the first pre-focus electrode 44, and more electron beams are saturated at the central axis, as shown in FIG. 39. FIG. 40 illustrates a distribution of electron beams before incidenting on a main lens. As shown in FIG. 40, current density is higher at the central portion of electron beams in the horizontal direction.

However, in above case, the horizontal size of an electron beam on the screen is increased, caused by repulsive space charge (electric) force of the electron beam.

As illustrated in FIG. 20, another method for reducing Db (V) is forming horizontally elongated the electron beam passing holes 444 on the relatively small electrode 443 of the first pre-focus electrode 44.

The horizontally elongated electron beam passing hole 444 enables the convergence force to work to the horizontal direction, and the divergence force to work to the vertical direction, thereby canceling the horizontal direction divergence force due to the vertically elongated electron beam passing hole 431 on the accelerating electrode 43.

Therefore, the horizontally elongated electron beam passing hole 444 on the first pre-focus electrode 44 can reduce the repulsive space charge force of the electron beam passing hole by distributing electron beams which are saturated at the central axis to outside, and can reduce the horizontal size of an electron beam formed on the screen.

On the other hand, the vertical direction divergence angle of an electron beam emitted from an electron gun with the above design is slightly greater than the horizontal direction divergence angle.

Figure 43:
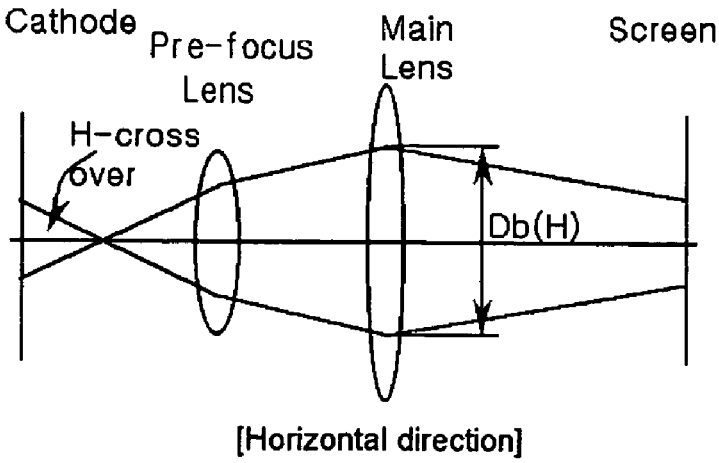
FIG. 43 illustrates convergence of an electron beam in accordance with an increase of horizontal divergence angle of the electron beam in the present invention.
Figure 44:
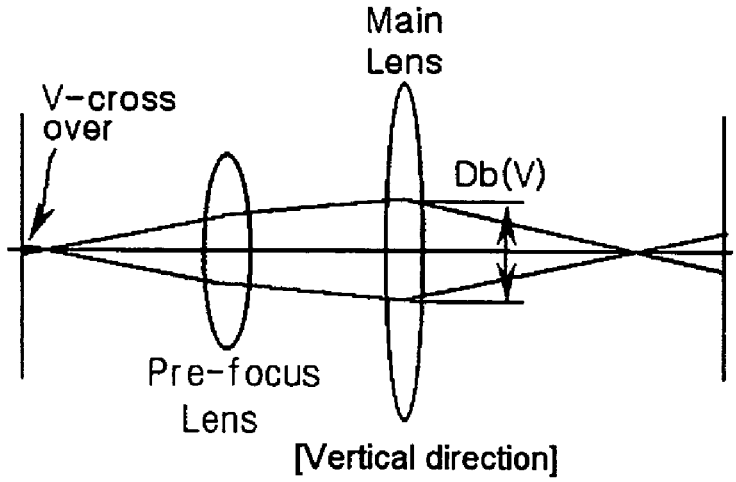
FIG. 44 illustrates convergence of an electron beam in accordance with a decrease of horizontal divergence angle of the electron beam in the present invention.
Figure 45:
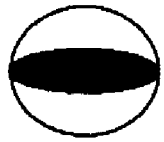
FIG. 45 illustrates an electron beam spot according to the present invention.

Accordingly, as shown in FIG. 43, as the horizontal direction divergence angle is increased, an electron beam converges at a rear side of the screen. Meanwhile, as shown in FIG. 44, the vertical direction divergence angle is decreased, and thus an electron beam converges in front of the screen.

As a result thereof, the electron beam formed on the screen is enlarged or magnified to a spot with a high brightness in the horizontal direction, but a low brightness in the vertical direction. This phenomenon is called "lack of astigmatism".

Figure 30:
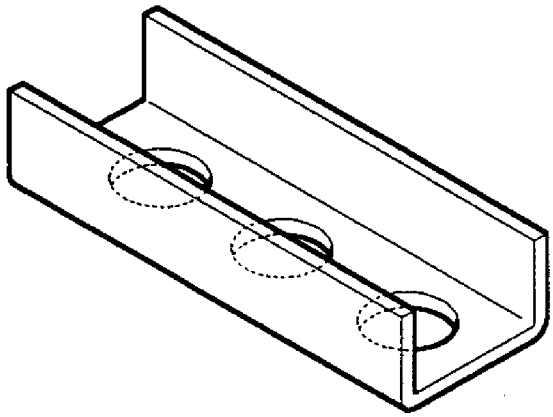
FIG. 30 illustrates an anode astigmatism correction electrode.
Figure 31:
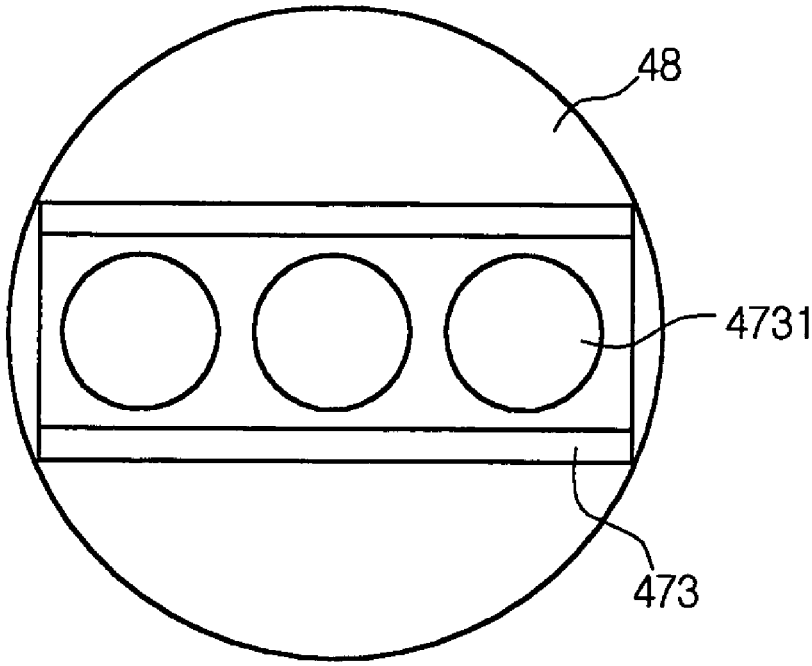
FIG. 31 illustrates an anode astigmatism correction electrode coupled with a shield cup according to the present invention.

To improve the lack of astigmatism, it is preferable to insert an anode astigmatism correction electrode 473, as shown in FIG. 30.

Figure 33:
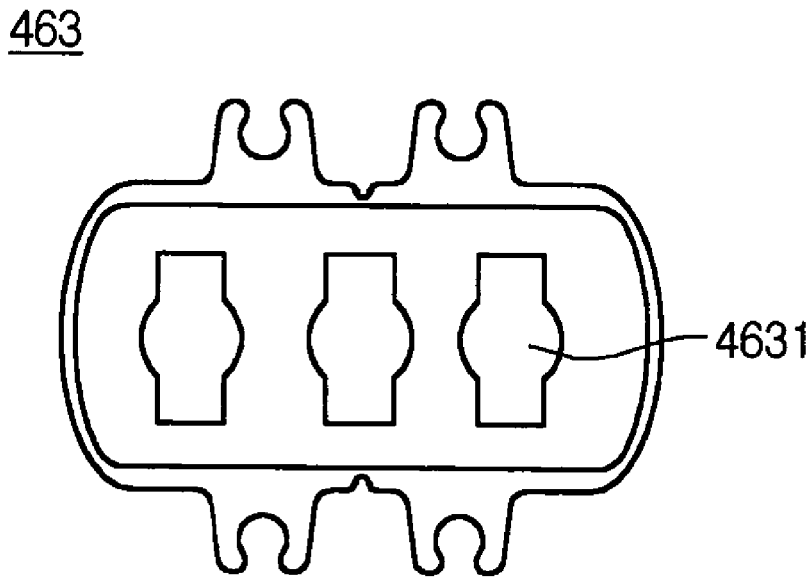
FIG. 33 illustrates an auxiliary electrode in the present invention.

Also, as shown in FIG. 33, it is more preferable to insert an auxiliary electrode 463 for astigmatism correction to the main focus electrode 46.

Although the auxiliary electrode 463 can be in a plate shape, it is better to be in a cap shape to maximize correction effect. The electron beam passing hole 4631 formed on the auxiliary electrode 463 is vertically elongated, and the vertical size of the passing hole 4631 is less than 8.0 mm.

Figure 46:
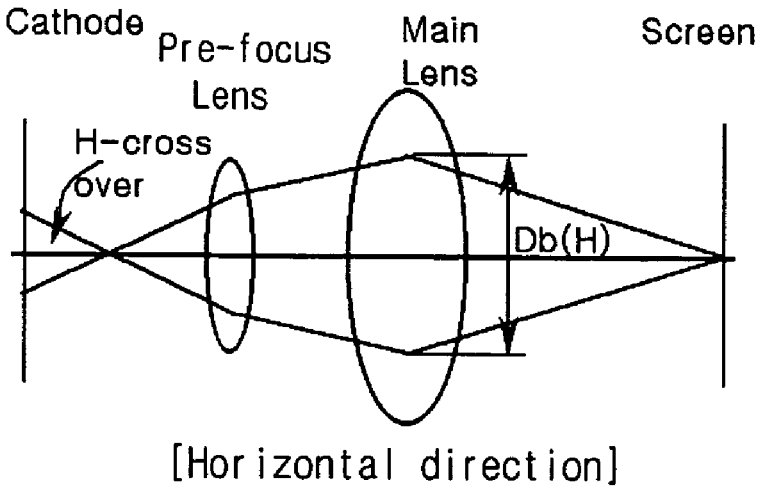
FIG. 46 and FIG. 47 illustrate convergence of an electron beam in horizontal and vertical directions in relation to convergence force according to the present invention.
Figure 47:
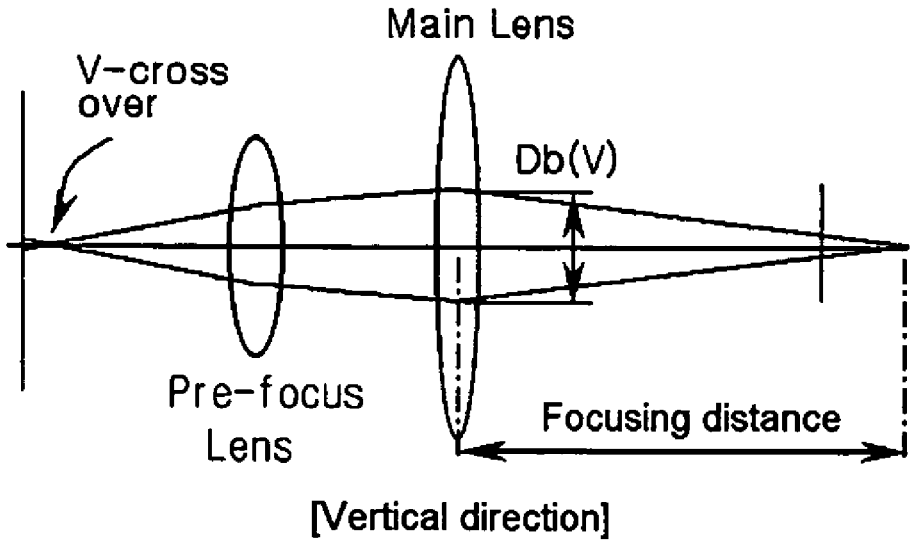
Figure 48:
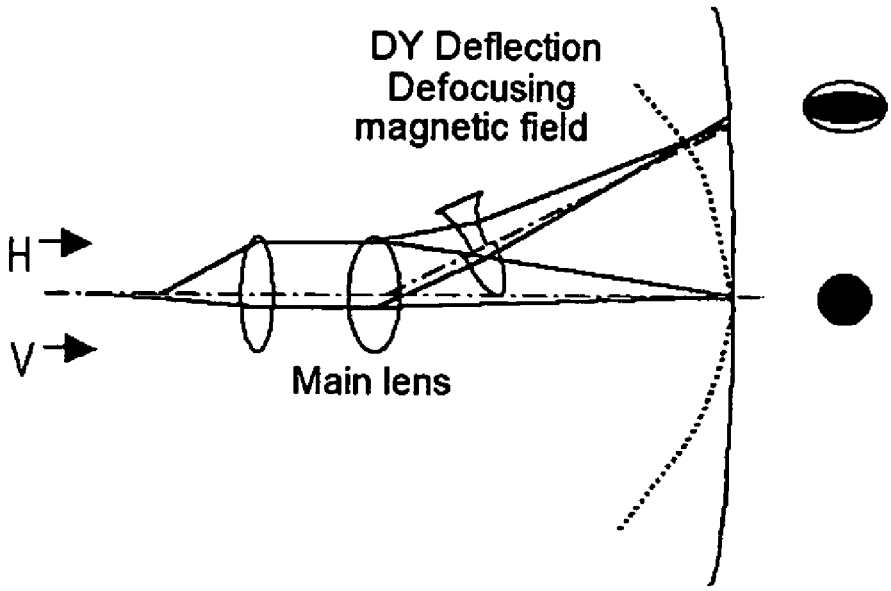
FIG. 48 illustrates a reduced spot size at the peripheral portion of a screen according to the present invention.

As depicted in FIGS. 46 and 47, according to the present invention, a strong convergence force working in the horizontal direction helps electron beams be converged precisely on the screen, and a weak convergence force working in the vertical direction helps electron beams be converged to a rear side of the screen. By designing a main lens to have this function, astigmatism at the center of the screen, that is, the difference between a focus voltage for optimizing the horizontal size of an electron beam at the center of the screen and a focus voltage for optimizing the vertical size of an electron beam at the center of the screen becomes greater than 600V. Therefore, as shown in FIG. 48, the spot size at the peripheral portion of the screen can be reduced by more than 50% of the one in the related art, and the resolution of the cathode ray tube is as good as when a dynamic voltage is applied.

Figure 49:
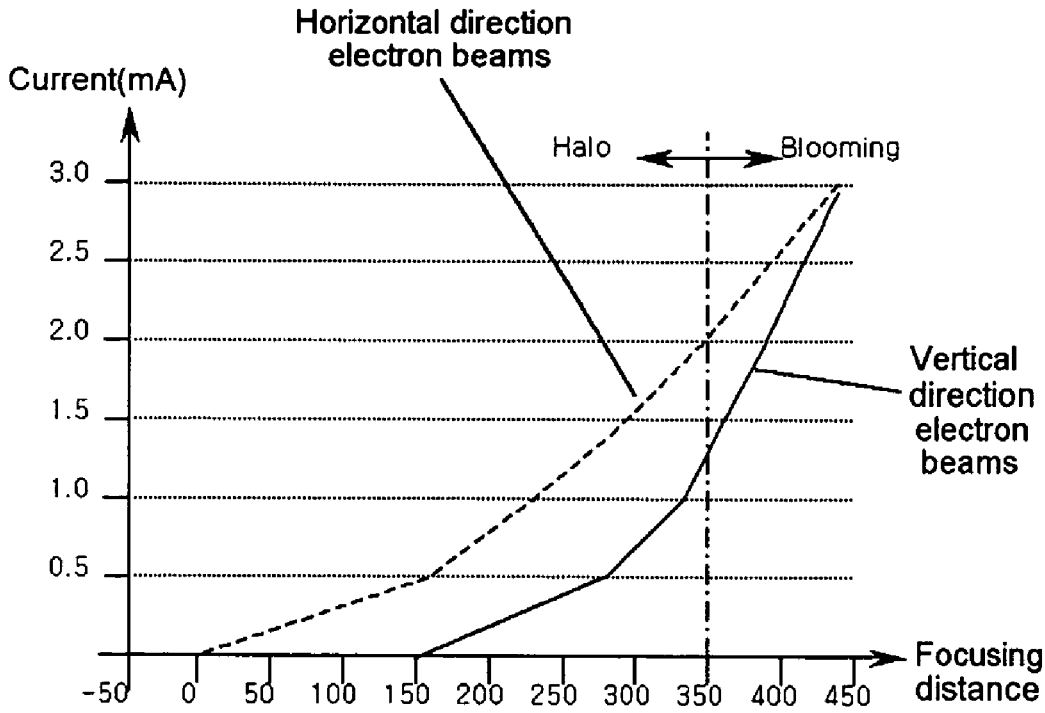
FIG. 49 graphically illustrates a relation between convergence distance and current intensity according to the present invention.

FIG. 49 graphically illustrates a relation between convergence distance and current intensity according to the present invention. Given that a distance from the main lens' center to the screen is approximately 350 mm, the focus distance of a vertical direction electron beam is increased in a high current region (higher than 2 mA), but the focus distance of a vertical direction electron beam is decreased in a low current area (lower than 2 mA). As a result thereof, a halo phenomenon occurs, resulting in deterioration of the resolution.

Figure 25:
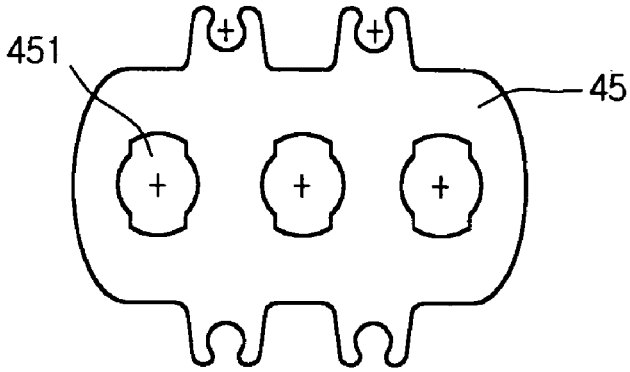
Figure 27:
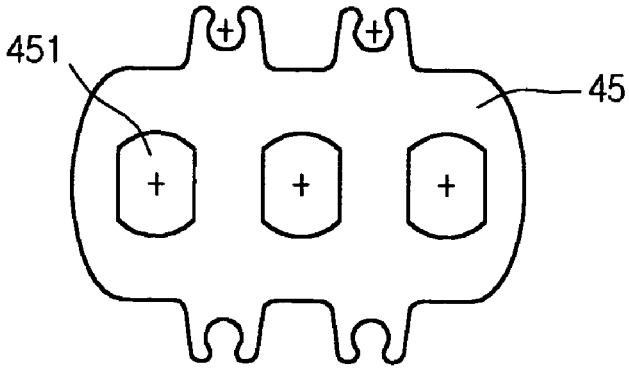

To overcome the halo phenomenon, electron beam passing holes 451 on the second pre-focus electrode 45 are vertically elongated, as shown in FIGS. 23, 25 and 27, so that the convergence force of electron beams depending on the change of current can be reduced and deterioration of the resolution can be prevented.

Figure 50:
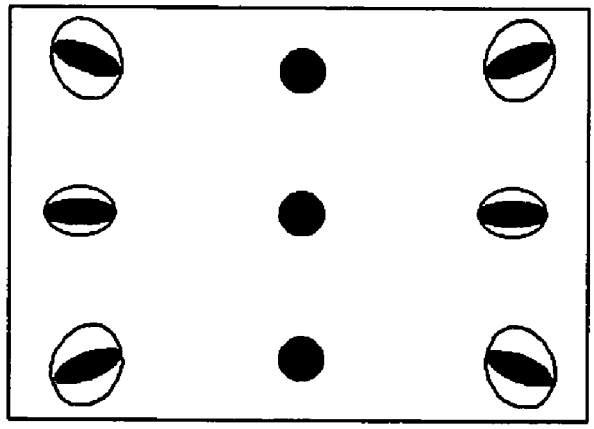
Fig.50 Related Art
FIG. 50 illustrates a shape of a spot on an entire screen of a related art electron gun.
Figure 51:
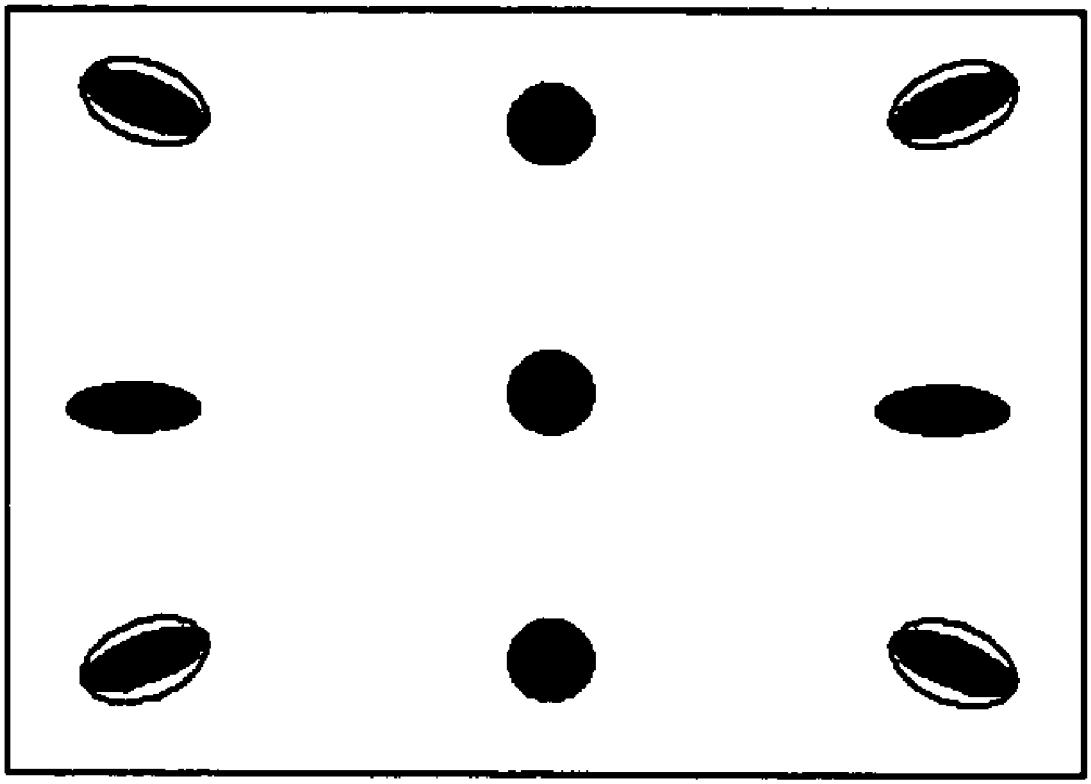
FIG. 51 illustrates a shape of a spot on an entire screen of an electron gun according to the present invention.

In conclusion, different from the spots of the related art electron gun shown in FIG. 50, the present invention makes it possible to obtain spots with an improved resolution as shown in FIG. 51.

In other words, the electron gun according to the present invention is capable of resolving the occurrence of the haze phenomenon at the peripheral portion of the screen, and of improving the resolution of the screen without an application of a dynamic voltage.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A cathode ray tube comprising:

a panel having a fluorescent screen formed on an inner surface;

a funnel connected to the panel;

an electron gun for emitting electron beams;

a deflection yoke for deflecting the electron beams in horizontal and vertical directions; and a shadow mask with a color selecting function, wherein the electron gun comprises a triode unit for generating electron beams, pre-focus lenses for preliminary focusing and accelerating the electron beams generated by the triode unit, and a main lens for finally focusing and accelerating the focused and accelerated electron beams through the pre-focus lenses, wherein a control electrode forming the triode unit has horizontally elongated electron beam passing holes, and an accelerating electrode forming the triode unit has vertically elongated electron beam passing holes or vertically elongated slots that are formed around the electron beam passing holes, wherein a vertical size of the electron beam passing hole on the control electrode is 40–70% of a horizontal size of the electron beam passing hole on the control electrode, wherein a horizontal size of the electron beam passing hole on the accelerating electrode is 80–90% of a vertical size of the electron beam passing hole on the accelerating electrode, and wherein a horizontal direction crossover of the electron beam is formed between the accelerating electrode and a first pre-focus electrode, or after the first pre-focus electrode, and a vertical direction crossover of the electron beam is formed between the control electrode and the accelerating electrode.

2. The cathode ray tube according to claim 1, wherein the horizontal size of the electron beam passing hole on the control electrode is 0.6 mm–0.8 mm, and the vertical size of the electron beam passing hole is 0.3 mm–0.45 mm.

3. The cathode ray tube according to claim 1, wherein the horizontal size of the electron beam passing hole on the accelerating electrode is 0.56 mm–0.7 mm, and the vertical size of the electron beam passing hole is 0.6 mm–0.8 mm.

4. The cathode ray tube according to claim 1, wherein an electron beam passing hole on a second pre-focus electrode forming the pre-focus lens has a circular shape.

5. The cathode ray tube according to claim 1, wherein a static voltage is applied to the pre-focus forming electrodes and to the main lens forming electrodes, respectively.

6. The cathode ray tube according to claim 5, wherein an applied voltage to a first pre-focus electrode among the pre-focus lens forming electrodes is 20–30% of an applied voltage to an anode.

7. The cathode ray tube according to claim 5, wherein an applied voltage to a second pre-focus electrode among the pre-focus lens forming electrodes is 400V–1000V.

8. The cathode ray tube according to claim 5, wherein an applied voltage to a main focus electrode among the main lens forming electrodes is 20–30% of an applied voltage to an anode.

9. The cathode ray tube according to claim 5, wherein an applied voltage to an anode among the main lens forming electrodes is 22 kV–35 kV.

10. The cathode ray tube according to claim 1, wherein a static voltage is applied to the accelerating electrode forming the triode unit.

11. The cathode ray tube according to claim 10, wherein an applied voltage to the accelerating electrode is 400V–1000V.

12. The cathode ray tube according to claim 1, wherein astigmatism at a center of a screen is greater than 600V.

13. The cathode ray tube according to claim 1, wherein a main focus electrode forming the main lens comprises at least two auxiliary electrodes.

14. The cathode ray tube according to claim 13, wherein electron beam passing holes formed on each of the auxiliary electrodes are in a vertically elongated shape.

15. The cathode ray tube according to claim 13, wherein one of the auxiliary electrodes disposed closer to a second pre-focus electrode has keyhole shaped electron beam passing holes.

16. The cathode ray tube according to claim 13, wherein one of the auxiliary electrodes disposed closer to a second pre-focus electrode is in a cap shape.

17. The cathode ray tube according to claim 1, wherein an auxiliary electrode is formed on an anode forming the main lens.

18. The cathode ray tube according to claim 17, wherein the auxiliary electrode is formed of one electron beam passing hole.

19. The cathode ray tube according to claim 1, wherein an astigmatism correction electrode is formed on an anode forming the main lens or on a shield cup.

20. The cathode ray tube according to claim 19, wherein the astigmatism correction electrode is formed of an electron beam passing hole, and includes a protruded plate portion at an upper and a lower part of the electron beam passing hole.

21. The cathode ray tube according to claim 1, wherein the electrodes forming the triode unit are in a plate shape.

22. The cathode ray tube according to claim 1, wherein thicknesses of the control electrode, the accelerating electrode, and a first pre-focus electrode forming a pre-focus lens satisfy a relation of thickness of the control electrode<thickness of the accelerating electrode<thickness of the first pre-focus electrode.

23. The cathode ray tube according to claim 22, wherein the first pre-focus electrode is formed of at least two plate-shape electrodes being coupled together.

24. The cathode ray tube according to claim 23, wherein among the plate-shape electrodes, a distance between centers of outside electron beam passing holes on a plate-shape electrode is different from a distance between centers of outside electron beam passing holes on a different plate-shape electrode.

25. The cathode ray tube according to claim 27, wherein among the plate-shape electrodes, a distance between centers of outside electron beam passing holes on a plate-shape electrode formed on an accelerating electrode side is greater than a distance between center of outside electron beam passing holes on a different plate-shape electrode.

26. The cathode ray tube according to claim 1, wherein among the electrodes forming the pre-focus lens, a gap between a first pre-focus electrode and a second pre-focus electrode is 1.05 mm–1.4 mm.

27. The cathode ray tube according to claim 1, wherein a gap between a second pre-focus electrode among the electrodes forming the pre-focus lens and the main lens is 1.05 mm–1.4 mm.

* * * * *